US012377324B2

(12) United States Patent
Matthews et al.

(10) Patent No.: US 12,377,324 B2
(45) Date of Patent: Aug. 5, 2025

(54) CO-MOLDED GOLF CLUB HEAD

(71) Applicant: KARSTEN MANUFACTURING CORPORATION, Phoenix, AZ (US)

(72) Inventors: Joshua B. Matthews, Phoenix, AZ (US); Clayson C. Spackman, Scottsdale, AZ (US); Les J. Bryant, Peoria, AZ (US); Rick D. MacMillan, Glendale, AZ (US); Terry J. Wells, Surprise, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/319,430

(22) Filed: May 17, 2023

(65) Prior Publication Data

US 2023/0372794 A1 Nov. 23, 2023

Related U.S. Application Data

(60) Provisional application No. 63/370,485, filed on Aug. 4, 2022, provisional application No. 63/364,873, filed on May 17, 2022.

(51) Int. Cl.
*A63B 53/04* (2015.01)

(52) U.S. Cl.
CPC ..... *A63B 53/047* (2013.01); *A63B 53/0433* (2020.08); *A63B 2053/0479* (2013.01)

(58) Field of Classification Search
CPC ..... A63B 53/0416; A63B 53/042; A63B 53/0425; A63B 53/0429
See application file for complete search history.

(56) References Cited

U.S. PATENT DOCUMENTS 5,083,778 A * 1/1992 Douglass ..... A63B 53/0487 473/329
5,299,807 A * 4/1994 Hutin ..... A63B 53/04 473/329
5,431,396 A * 7/1995 Shieh ..... A63B 53/0466 473/332
5,522,593 A 6/1996 Kobayashi
5,993,329 A * 11/1999 Shieh ..... A63B 53/0466 473/345
6,001,030 A * 12/1999 Delaney ..... A63B 53/0487 473/340
6,083,117 A * 7/2000 Hsu ..... A63B 53/0487 473/340
6,273,831 B1 * 8/2001 Dewanjee ..... A63B 53/04 473/340
6,364,789 B1 * 4/2002 Kosmatka ..... A63B 53/0466 473/345
6,491,593 B2 * 12/2002 Takeda ..... A63B 60/00 473/349
6,672,975 B1 * 1/2004 Galloway ..... A63B 53/0466 473/349

(Continued)

FOREIGN PATENT DOCUMENTS

GB 788847 1/1958
JP 0691021 4/1994

(Continued)

*Primary Examiner* — Alvin A Hunter

(57) ABSTRACT

A golf club head comprising a face plate, a body, bonding material, and at least one retainer, wherein the bonding material and at least one retainer are the sole medium coupling the face plate and body.

16 Claims, 18 Drawing Sheets

(56) References Cited

U.S. PATENT DOCUMENTS 6,835,144 B2 12/2004 Best
6,964,617 B2 * 11/2005 Williams ..... A63B 53/0466 473/345
7,094,159 B2 * 8/2006 Takeda ..... A63B 53/0466 473/345
7,226,366 B2 * 6/2007 Galloway ..... A63B 60/00 473/332
7,367,900 B2 * 5/2008 Kumamoto ..... A63B 53/0466 473/348
7,473,186 B2 * 1/2009 Best ..... A63B 53/0487 473/340
7,582,024 B2 * 9/2009 Shear ..... A63B 60/52 473/332
7,601,077 B2 * 10/2009 Serrano ..... A63B 53/0487 473/340
8,092,318 B2 * 1/2012 Oldknow ..... A63B 53/04 473/332
8,206,241 B2 * 6/2012 Boyd ..... A63B 53/047 473/332
8,523,698 B2 * 9/2013 Hotaling ..... A63B 53/04 473/340
8,668,598 B2 3/2014 Gilbert
9,808,685 B1 11/2017 Westrum
10,039,964 B1 8/2018 Westrum
10,150,021 B2 * 12/2018 Kitagawa ..... A63B 53/0466
10,814,192 B2 10/2020 Sander
11,020,638 B2 * 6/2021 Takahashi ..... A63B 53/047
11,701,554 B2 * 7/2023 Matsunaga ..... A63B 53/0458 473/342
11,969,630 B2 * 4/2024 Carr ..... A63B 53/042
2002/0065144 A1 * 5/2002 Helmstetter ..... C08G 18/10 473/340
2002/0094883 A1 * 7/2002 Chuang ..... A63B 53/047 473/332
2002/0103041 A1 * 8/2002 Murphy ..... B29C 70/865 473/345
2004/0106465 A1 * 6/2004 Dewanjee ..... A63B 53/0466 473/340
2005/0054462 A1 * 3/2005 Breier ..... A63B 53/0487 473/340
2005/0119067 A1 * 6/2005 Dewanjee ..... A63B 53/0466 473/340
2005/0119069 A1 * 6/2005 Guard ..... A63B 53/0487 473/340
2005/0233830 A1 * 10/2005 Williams ..... A63B 60/00 473/345
2006/0052177 A1 * 3/2006 Nakahara ..... A63B 53/0466 473/345
2007/0293345 A1 12/2007 Serrano
2009/0082131 A1 * 3/2009 Best ..... A63B 60/00 473/340
2011/0172023 A1 7/2011 Gilbert
2011/0218050 A1 * 9/2011 Ballenger ..... A63B 53/04 473/409
2013/0324280 A1 12/2013 Boyd
2014/0080633 A1 * 3/2014 Bezilla ..... A63B 53/04 473/342
2014/0080634 A1 * 3/2014 Golden ..... A63B 53/0466 473/345
2014/0274454 A1 * 9/2014 Snyder ..... A63B 53/047 473/332
2014/0323237 A1 * 10/2014 Beno ..... A63B 53/04 72/352
2015/0038259 A1 2/2015 Sander
2015/0057101 A1 * 2/2015 Sander ..... A63B 53/047 473/342
2015/0094164 A1 * 4/2015 Galvan ..... A63B 60/54 473/329
2015/0174461 A1 * 6/2015 Bennett ..... A63B 53/0466 473/329
2016/0346636 A1 * 12/2016 Sander ..... A63B 53/047
2016/0346646 A1 * 12/2016 Bennett ..... A63B 60/00
2017/0157474 A1 6/2017 Sander
2017/0361178 A1 * 12/2017 Kitagawa ..... A63B 53/0466
2019/0224533 A1 * 7/2019 Spackman ..... A63B 60/02
2020/0282274 A1 9/2020 Spackman
2020/0282277 A1 9/2020 Spackman
2020/0353320 A1 11/2020 Bacon
2022/0379175 A1 * 12/2022 Martens ..... B29C 66/7212
2023/0372794 A1 * 11/2023 Matthews ..... A63B 53/0433
2024/0173599 A1 * 5/2024 Carr ..... A63B 53/0416
2024/0226670 A1 * 7/2024 Galvan ..... A63B 53/0458

FOREIGN PATENT DOCUMENTS

JP 2874103 3/1999
JP 2009178182 A * 8/2009
JP 2014008287 A * 1/2014
JP 2014205081 A * 10/2014 ..... A63B 53/0466
KR 20200119693 10/2020
TW 553754 9/2003
TW 200914084 4/2009

* cited by examiner

CO-MOLDED GOLF CLUB HEAD

CROSS REFERENCE PRIORITIES

This claims the benefit of U.S. Provisional Application No. 63/364,873, filed May 17, 2022; and U.S. Provisional Application No. 63/370,485, filed Aug. 4, 2022, the contents of which are fully incorporated herein by reference.

FIELD OF INVENTION

The present disclosure relates generally to golf equipment, and more particularly, to golf heads. In particular, the present invention is to a co-molded golf club head.

BACKGROUND

A golf club head comprises a face plate and body. Conventionally, the face plate and body are welded together. To enable welding, however, the face plate and body must be formed of compatible materials, such as those having substantially similar hardness, density, and stiffness. This limits golf club head design, as different characteristics may be desirable for the face plate and body. For example, it may be desirable for the face plate to be harder relative to the body to improve the face plate's susceptibility to wear or reactivity to a golf ball impact. Further, it may be desirable to lighten the face plate without sacrificing durability. Namely, a lighter face plate moves weight away from the club head center and towards the club head perimeter thereby increasing moment of inertia (MOI) for the entire club head. Further, a lighter face plate reduces structural mass, thereby providing more discretionary mass. While conventional club heads have attempted to introduce flexible polymer material in between the body and strike plate to improve at least one of sound, feel, or flexibility, conventional club heads fail to utilize a face plate and body with different material properties. Further, conventional club heads have attempted to increase ball speed by thinning the face and providing structural support to the face plate through a flexible polymer, however, these conventional club heads have a lower limit of how thin the face plate can be due to the amount of support the soft polymer provides, and because the face plate must withstand welding. Therefore, a need exists to provide a golf club head comprising a face plate and body with differing material properties to improve at least one of sound, feel, MOI, ball speed, or flexibility without sacrificing durability.

Figure 1:
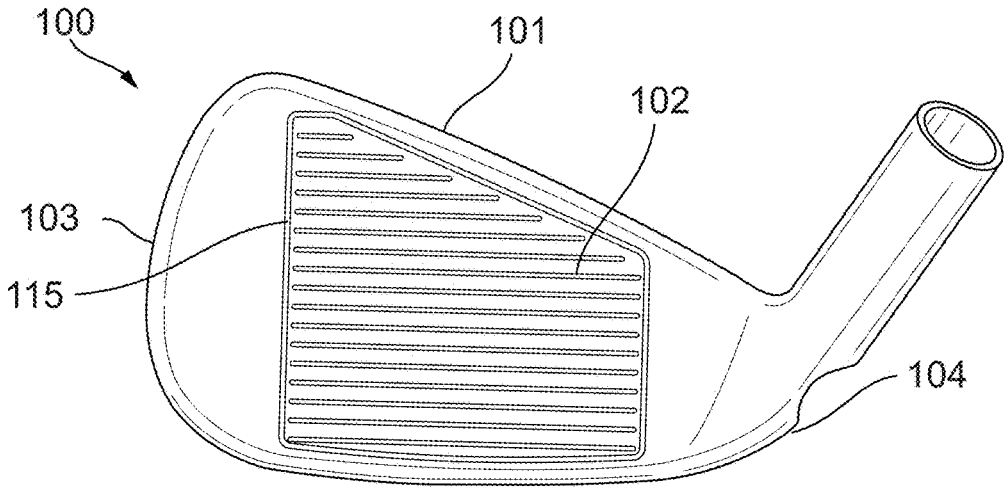
FIG. 1 illustrates a front view of a golf club head according to a first embodiment.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

Described herein is a golf club head comprising a face plate, body, and bonding material disposed between the face plate and body. The face plate and body are coupled solely by the bonding material (i.e., the face plate and body are co-molded). The face plate or body further comprise at least one retainer, disposed within the club head, wherein the bonding material surrounds the at least one retainer to securely couple the face plate and body without a weld. By coupling the body and face plate solely via the bonding material, weld restrictions are eliminated for differing face plate and body materials.

The face plate and body comprise different material properties. For example, the face plate may comprise a material having a lower density than the body material. A lower density face plate alters weight distribution to favor perimeter weighting, thereby increasing MOI and offering more discretionary mass.

Further, the bonding material provides structural support for the face plate, thereby alleviating structural concerns on the face plate, such as durability, bending stresses and flexibility. For example, the face plate may be thinner and harder than in the absence of the bonding material. In some embodiments the bonding material can comprise a void located behind the face plate to aid in improving ball speed across the face plate. These advantages would not be achievable if the body and face plate were welded together instead of coupled via the bonding material and at retainer.

Definitions

The term "face plate," as described herein, refers to a plate attached to a golf club body that contacts a golf ball during a swing. The face plate can extend to also form a portion of the top rail, a portion of the sole, or a portion of the toe.

The term "body" as described herein, refers to the portion of the golf club head extending rearward of the face plate.

The term "strike face," as described herein, refers to the combination of the face plate and body portions that are co-planer forming a surface intended to strike golf ball.

The term "bonding material" as described herein, refers to material disposed between, and coupling, the face plate and body.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The term "iron," as described herein, can, in some embodiments, refer to an iron-type golf club head having a loft angle that is less than approximately 60 degrees, less than approximately 58 degrees, less than approximately 56 degrees, less than approximately 54 degrees, less than approximately 52 degrees, less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, or less than approximately 40 degrees. Further, in many embodiments, the loft angle of the club head is greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, greater than approximately 25 degrees, greater than approximately 30 degrees, greater than approximately 35 degrees, greater than approximately 40 degrees, greater than approximately 45 degrees, greater than approximately 50 degrees, greater than approximately 55 degrees, or greater than approximately 60 degrees.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

An "XYZ" coordinate system of the golf club head, as described herein, is based upon the geometric center of the face plate. The golf club head dimensions as described herein can be measured based on a coordinate system as defined below. The geometric center of the face plate defines a coordinate system having an origin located at the geometric center of the face plate. The coordinate system defines an X axis, a Y axis, and a Z axis. The X axis extends through the geometric center of the face plate in a direction from the heel to the toe of the fairway-type club head. The Y axis extends through the geometric center of the face plate in a direction from the top rail to the sole of golf club head. The Y axis is perpendicular to the X axis. The Z axis extends through the geometric center of the face plate in a direction from the front end to the rear end of the golf club head. The Z axis is perpendicular to both the X axis and the Y axis.

The term or phrase "center of gravity position" or "CG location" can refer to the location of the club head center of gravity (CG) with respect to the XYZ coordinate system, wherein the CG position is characterized by locations along the X-axis, the Y-axis, and the Z-axis. The term "CGx" can refer to the CG location along the X-axis, measured from the origin point. The term "CG height" can refer to the CG location along the Y-axis, measured from the origin point. The term "CGy" can be synonymous with the CG height. The term "CG depth" can refer to the CG location along the Z-axis, measured from the origin point. The term "CGz" can be synonymous with the CG depth.

The term or phrase "CG projection" or "CG projection point" can refer to the location where the CG is projected on the face plate, wherein the projection is taken normal to the loft plane.

The XYZ coordinate system of the golf club head, as described herein defines an XY plane extending through the X axis and the Y axis. The coordinate system defines XZ plane extending through the X axis and the Z axis. The coordinate system further defines a YZ plane extending through the Y axis and the Z axis. The XY plane, the XZ plane, and the YZ plane are all perpendicular to one another and intersect at the coordinate system origin located at the geometric center of the face plate. In these or other embodiments, the golf club head can be viewed from a front view when the face plate is viewed from a direction perpendicular to the XY plane. Further, in these or other embodiments, the golf club head can be viewed from a side view or side cross-sectional view when the heel is viewed from a direction perpendicular to the YZ plane.

The golf club head further comprises a coordinate system centered about the center of gravity. The coordinate system comprises an X'-axis, a Y'-axis, and a Z'-axis. The X'-axis extends in a heel-to-toe direction. The X'-axis is positive towards the heel and negative towards the toe. The Y'-axis extends in a sole-to-top rail direction and is orthogonal to both the Z'-axis and the X'-axis. The Y'-axis is positive towards the top rail and negative towards the sole. The Z-axis extends front-to-rear, parallel to the ground plane and is orthogonal to both the X'-axis and the Y'-axis. The Z'-axis is positive towards the face plate and negative towards the rear.

The term or phrase "moment of inertia" (hereafter "MOI") can refer to a value derived using the center of gravity (CG) location. The MOI can be calculated assuming the club head includes the body and the hosel structure. The term "MOIxx" or "Ixx" can refer to the MOI measured about the X'-axis. The term "MOIyy" or "Iyy" can refer to the MOI measured about the Y'-axis. The term "MOIzz" or "Izz" can refer to the MOI measured about the Z'-axis. The MOI values MOIxx, MOIyy, and MOIzz determine how forgiving the club head is for off-center impacts with a golf ball.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

DETAILED DESCRIPTION

The golf club head described herein comprises features for improving sound, feel, MOI, CG position, ball speed, and at least maintaining durability. The golf club head may comprise a face plate, a body, and a bonding material, wherein the body and face plate are co-molded via the bonding material and at least one retainer. Namely, the face plate is not welded to the body. At least one retainer is used via the face plate or the body to engage the bonding material and thus securely couple the body and face plate. Further, the face plate perimeter and body interior are engaged via the bonding material. There is no contact between the face plate and the body. The face plate only contacts the bonding material, and the body only contacts the bonding material. A lip is formed along the perimeter of the face plate. The lip comprises the bonding material and sets a boundary between the face plate and the body.

The face plate is not welded to the body. Without a weld, restrictions imposed by welding, such as material compatibility, are eliminated. Therefore, the face plate and body may comprise materials which are prohibitively difficult to weld. If one were to attempt to weld a face plate to a body, wherein the face plate and body comprise dissimilar materials, each material would melt independently, and cool without forming a bond with the other material. Accordingly, it is often prohibitively difficult to weld dissimilar materials.

The freedom provided by securing a face plate to the body via a bonding material and at least one retainer permits club head material combinations that are not achievable in convention club heads. For example, materials may be selected wherein the face plate comprises a lower density than the body density. The lower face plate density may be achieved by unique material selection, or by varying the face plate production (e.g., heat treatment) from the body. Lowering the face plate density eliminates mass from the center of the club head, thereby increasing the club head MOI. Further, reducing mass from the club head center provides discretionary mass which can be re-distributed, preferably towards the club head perimeter, including the rear and sole, to improve MOI and CG positioning.

Also, the face plate may comprise a substantially high hardness, improving the face plate's durability. Increased face plate durability is particularly important for club heads, such as wedges, where changes in spin production may drastically affect performance, as spin production is driven by groove design. As club head repeatedly strike a golf ball, the grooves on a club head degrade and the spin imparted on the golf ball is reduced. Thus, a harder face plate may provide more durable grooves that maintain their geometry after repeated impact and thus maintain spin rates.

Further, the bonding material not only holds the club head together, but also structurally supports the face plate. Contrary to conventional club heads utilizing a soft polymer, the presence of the bonding material provides substantial structural support to the face plate. Therefore, the face plate can be substantially thinner than a conventional club head face plate. A thinner face plate removes mass between the club head perimeter, thereby increasing MOI. Additionally, a thinner face plate reduces structural mass, thereby allowing discretionary mass to improve MOI and CG. By contrast, a conventional club head where the face plate is not substantially supported by a bonding material would not be able to achieve a face plate as thin as the present invention. Namely, in a conventional club head, the face plate must be substantially thick to avoid failure due to bending stresses. Additionally, a conventionally welded club head must comprise a face plate that is thick enough to withstand welding. Therefore, the club head of the present invention simultaneously achieves performance benefits that are typically conflicting. For example, the club head can comprise a durable, light-weight face plate that minimizes groove wear while also increasing ball speed and MOI.

Specifically, the bonding material supports the face plate by bearing a substantial amount of the bending stress applied to the club head. Accordingly, the rear body, including the top rail and sole, experiences little flexure. Since the rear body remains rigid upon impact with a golf ball, the face plate edges near the top rail and sole are restricted. Accordingly, since face plate bending is restricted, the face plate can be thin relative to conventionally welded face plates.

Regarding ball speed, embodiments where the bonding material continuously engages the face plate and body improves ball speed for off center hits, thereby promoting ball speed consistency. Namely, when the bonding material continuously supports the face plate, a thin face plate may be implemented which increases MOI by removing structural mass between the club head perimeter. Increased MOI improves ball speed for off-center hits. Accordingly, the present invention may produce increased ball speed for off-center hits relative to a golf club head of similar design that requires welding.

To further improve ball speed, the bonding material may have discrete voids adjacent to the face plate. These discrete voids allow localized face plate flexure. These voids can further be used to increase the characteristic time (hereafter "CT"). The CT is locally dependent across the face plate. Face plates typically have CT "hot" spots and "cold" spots.

Accordingly, voids can be placed behind the "cold" spots to increase the CT while the bonding material can supports the face plate behind the "hot" spots. This structure creates a consistent CT across the face plate. Accordingly, this non-continuous coupling of the face plate and body may normalize ball speed across the face. For example, discrete voids may be placed near the top and bottom of the face plate, thereby increasing ball speed for high and low hits respectively. Additionally, the discrete voids can encourage localized flexure near the face plate center, thereby increasing top-end ball speed.

Improvements in sound and feel relative to conventional design are achieved via a club head comprising a bonding material. To achieve improvements in sound and feel the bonding material can either continuously engage the face plate and body or can discontinuously engages the face plate and body. Specifically, the bonding material dampens the sound produced when striking a ball. Further, the bonding material reduces vibrations imparted to the club head when striking a ball, thereby improving feel, particularly for off-center hits. Further, internal weights can be embedded in the bonding material instead of welded to the body as done in conventional club heads. Accordingly, the bonding material may resist movement, or rattling, of the internal weight. Therefore, the embodiments described in more detail below provide overall feel, performance, and constructional advantages over conventional club heads that comprise a flexible filler material between a welded face plate and body.

Figure 2:
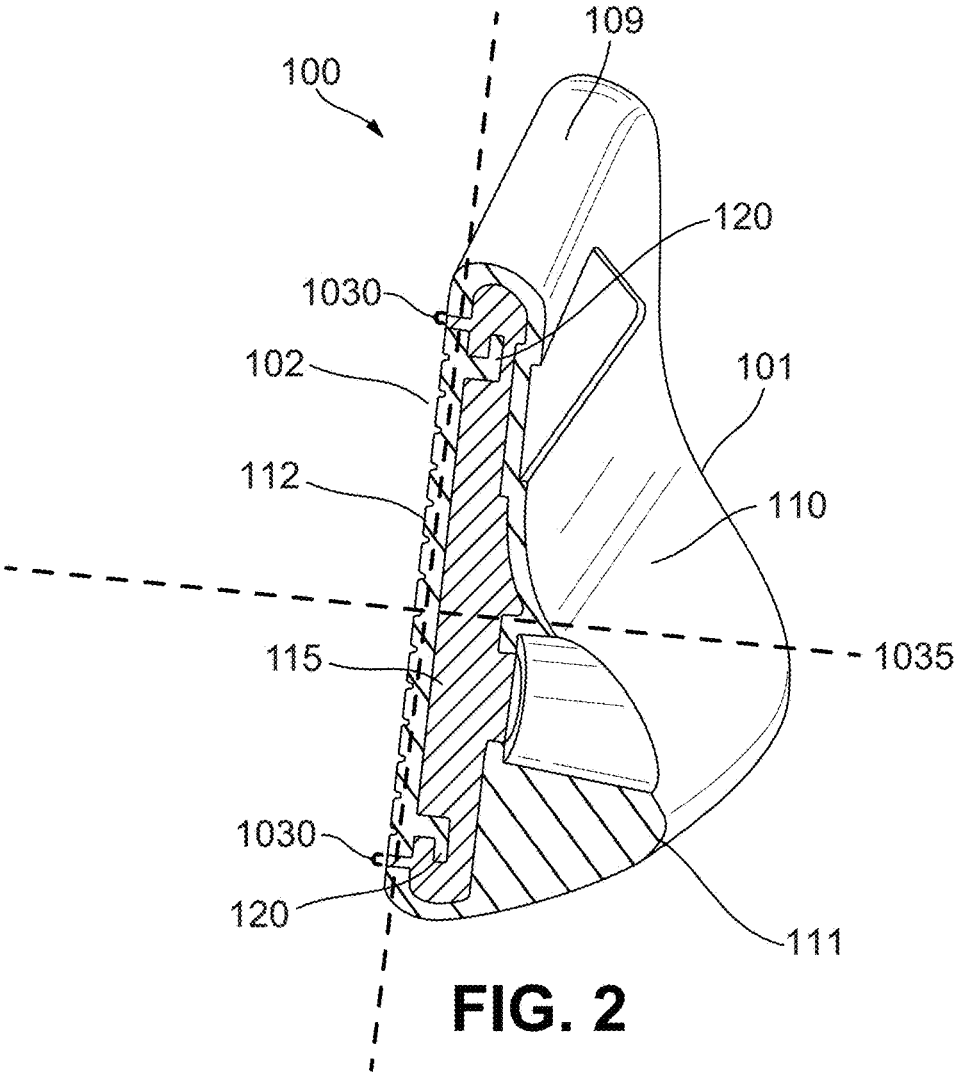
FIG. 2 illustrates a side cross-sectional perspective view of FIG. 1 golf club head.
Figure 3:
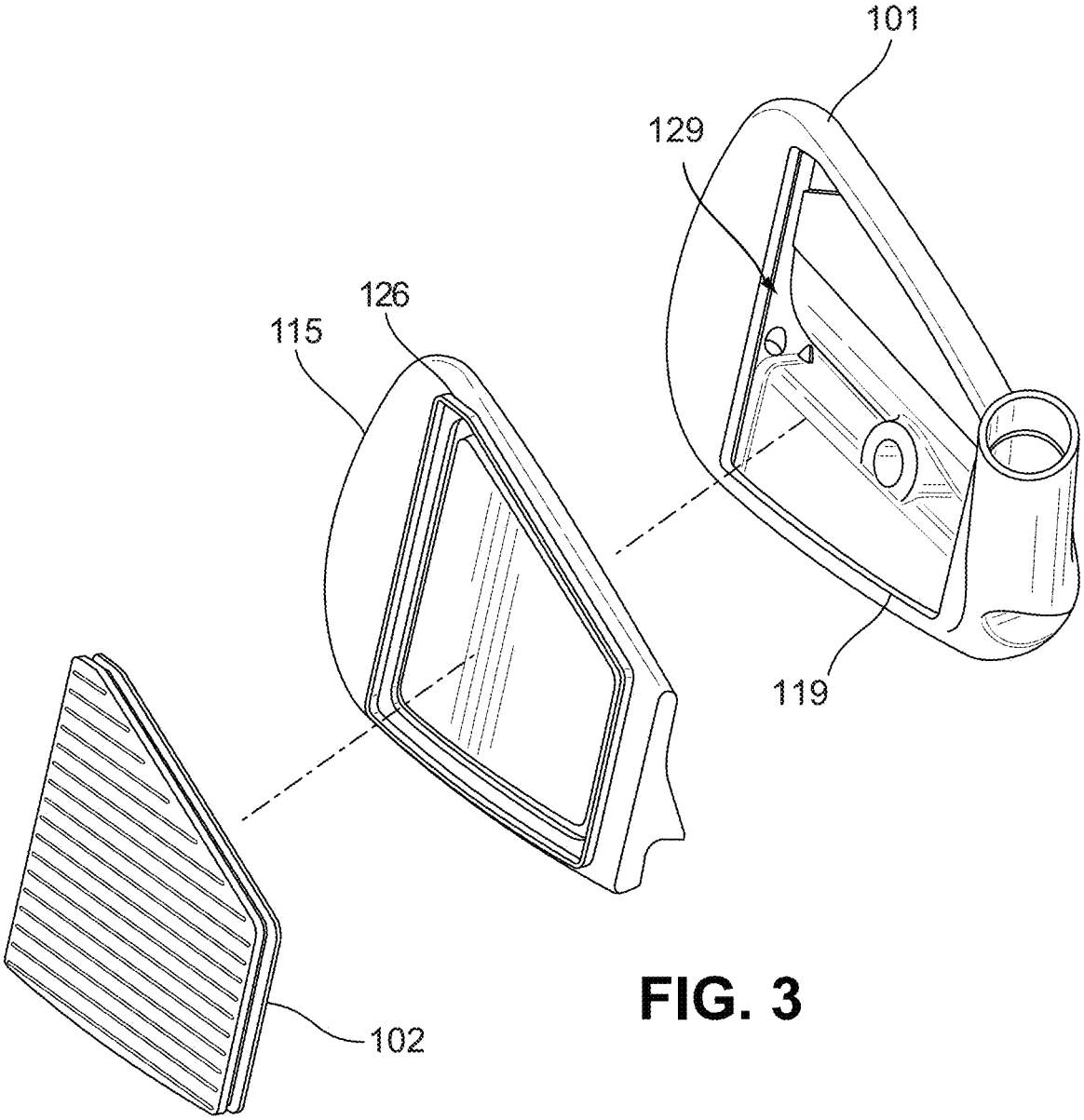
FIG. 3 illustrates an exploded view of the FIG. 1 golf club head.
Figure 4:
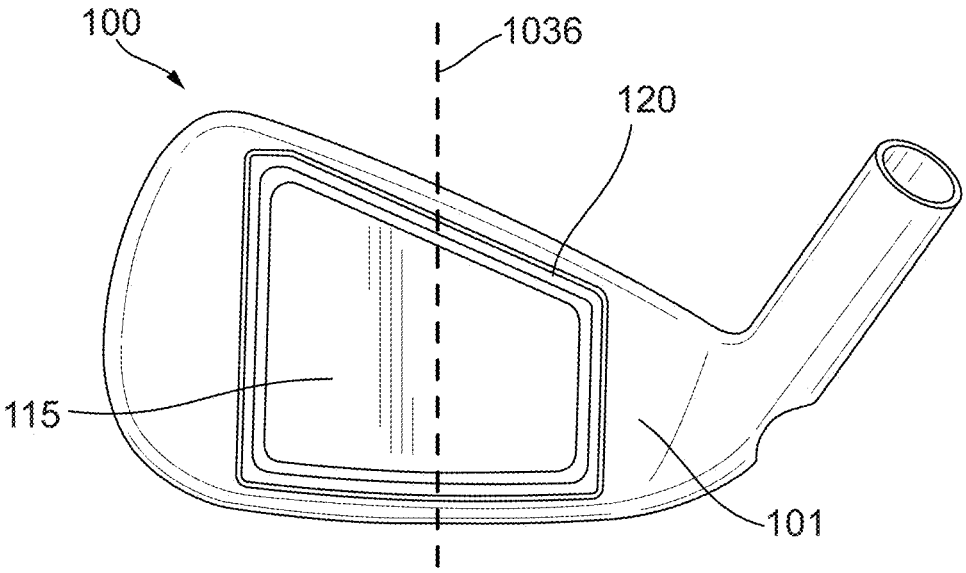
FIG. 4 illustrates a front view of the FIG. 1 golf club head body.

Referring to FIGS. 1-3, the club head 100 may comprise a face plate 102, a body 101, a hosel 105, and a bonding material 115, wherein the bonding material 115 crosslinks the face plate 102 to the body 101. The face plate 102 may comprise a strike face 112 and a rear surface 113. The body 101 may comprise a heel end 104, a toe end 103, a top rail 109, a sole 111, a rear end 110, and a frame 119. The frame 119 defines a continuous boundary, hereafter the body opening 129, around the front end of the body 101. The body opening 129 is configured to receive the face plate 102. Wherein the face plate 102 is sized to leave a gap or offset 1030 between the face plate 102 and the frame 119. The gap 1030 may be filled by the bonding material 115 to engage the face plate and the body 101. Specifically, the bonding material 115 may comprise a lip 126, which extends between the face plate peripheral edge and the frame 119.

The club head 100 may further comprise at least one retainer 120, wherein the bonding material 115 engages the retainer 120 to securely couple the face plate 102 and body 101. Further, the bonding material 115 may comprise a lobe or lug 125 that engages the retainer 120. Specifically, the face plate 102 may comprise at least one retainer 120 and the body 101 may comprise at least one retainer 122. The interaction between the bonding material 115, face plate 102, and body 101 offers unique performance advantages. Namely, the club head 100 may achieve improved sound, feel, MOI, CG, ball speed, and durability. By contrast, the prior art is restricted to only achieving some of these benefits, and usually at the expense of the remaining benefits.

These performance advantages are made possible because the face plate 102 is not welded to the body 101. Instead, the face plate 102 and body 101 are co-molded together through the bonding material 115 and at least one retainer 120.

Accordingly, since the face plate 102 is not welded to the body 101, material compatibility for welding is not relevant. Thus, the face plate 102 and body 101 can be different materials. Accordingly, materials can be uniquely chosen to achieve desirable performance benefits.

The face plate 102 can be formed from materials that typically cannot be welded to a body 101. For example, the face plate 102 can be formed from titanium. While titanium face plates are commonly used in wood-type golf clubs, their integration into a steel body iron-type club typically requires adhesive bonding or mechanical fastening. However, such traditional options for engaging a titanium face plate to a steel body may be prohibitively expensive, or burdensome to manufacture. By contrast, the present invention may successfully integrate a titanium face via the bonding material. Integrating a titanium face plate is desirable because titanium is lighter than steel. For example, a titanium alloy face plate can have a density of approximately 4 g/cm$^3$ while steel has a density of approximately 7.8 g/cm$^3$. Effectively, integrating a titanium face plate via the bonding material results in a face plate that is approximately half as dense as conventionally welded face plates. Thus, the club head 100 has less structural mass between the club head perimeter thereby increasing MOI. Also, the club head 100 has more discretionary mass to further increase moment of inertia and shift the center of gravity lower and further rearward.

Additionally, the face plate 102 can be formed from a metal matrix composite, such as a magnesium matrix composite. A magnesium matrix composite has a magnesium alloy base and may be fiber reinforced. For example, carbon fiber can be used to reinforce the magnesium alloy. As a result, a magnesium matrix composite face plate 102 would comprise a very low density, such as 1.8 g/cm$^3$. By contrast, a conventional steel face plate comprises a density of approximately 8 g/cm$^3$. Though, magnesium is just one example of a metal used to form the metal matrix. Various other metals can form the matrix, including titanium, steel, copper, cobalt, nickel, and aluminum. Further, carbon fiber is just one example of a reinforcement in a metal matrix composite. Various other reinforcements can be used. Generally, ceramics, such as silicon carbide, alumina, and fiberglass can reinforce the metal matrix. Additionally, another metal, such as titanium, steel, aluminum, copper, cobalt, nickel, and magnesium can reinforce the metal matrix. Further, the reinforcement can be provided in the form of discontinuous fibers, continuous fibers, or a mix of both.

Specifically, the face plate 102 and body 101 each comprise a modulus of elasticity. Since the face plate 102 and body 101 are not welded together but are held together by the bonding material and retainer, the face plate 102 and body 101 can have different moduli of elasticity.

For example, the face plate 102 modulus of elasticity may be greater than the body 101 modulus of elasticity (i.e., the face plate material 102 is less flexible than the body material 101). Having a relatively rigid face plate 102 may be preferable where face plate 102 bending is restricted by the bonding material 115 because face plate 102 hardness may be prioritized instead of flexibility.

Alternatively, the face plate 102 modulus of elasticity may be smaller than the body 101 modulus of elasticity (i.e., the face plate 102 is more flexible than the body 101). Having a relatively flexible face plate 102 may be preferable where the face plate 102 is not continuously supported by the bonding material 115. For example, referring to FIGS. 9A-9D, where the club head has discrete voids 709A-D between the face plate 702A-D, and bonding material 715A-D, a flexible face plate 712A-D facilitates ball speed improvement.

Specifically, the face plate 102 modulus of elasticity may be between 60 GPa and 140 GPa. In some embodiments the face plate modulus of elasticity may be between 60 GPa and 70 GPa, between 70 GPa and 80 GPa, between 80 GPa and 90 GPa, between 90 GPa and 100 GPa, between 100 GPa and 110 GPa, between 110 GPa and 120 GPa, between 120 GPa and 130 GPa, or between 130 GPa and 140 GPa.

Further, the body 101 modulus of elasticity may be between 40 GPa and 300 GPa. In some embodiments, the body modulus of elasticity may be between 40 GPa and 100 GPa, between 100 GPa and 150 GPa, between 150 GPa and 200 GPa, between 200 GPa and 220 GPa, between 220 GPa and 240 GPa, between 240 GPa and 260 GPa, between 260 GPa and 280 GPa, or between 280 GPa and 300 GPa.

Further, the face plate 102 comprises a face plate density, and the body 101 comprises a body density. The face plate density may be between 1.5 g/cm$^3$ and 18 g/cm$^3$. In some embodiments, the face plate density may be between 1.5 g/cm$^3$ and 9 g/cm$^3$, or even between 1.5 g/cm$^3$ and 4 g/cm$^3$. Further, the face plate density may be between 1.5 g/cm$^3$ and 3.0 g/cm$^3$, or between 3.0 g/cm$^3$ and 4.5 g/cm$^3$, or between 4.5 g/cm$^3$ and 6.0 g/cm$^3$, or between 6.0 g/cm$^3$ and 7.5 g/cm$^3$, or between 7.5 g/cm$^3$ and 9.0 g/cm$^3$. Specifically, the face plate density may be 1.5 g/cm$^3$, 2.0 g/cm$^3$, 2.5 g/cm$^3$, 3.0 g/cm$^3$, 3.5 g/cm$^3$, 4.0 g/cm$^3$, 4.5 g/cm$^3$, 5.0 g/cm$^3$, 5.5 g/cm$^3$, 6.0 g/cm$^3$, 6.5 g/cm$^3$, 7.0 g/cm$^3$, 7.5 g/cm$^3$, 8.0 g/cm$^3$, 8.5 g/cm$^3$, or 9.0 g/cm$^3$. The body density may be between 6 g/cm$^3$ and 10 g/cm$^3$. In some embodiments, the body density may be between 7 g/cm$^3$ and 9 g/cm$^3$, or even between 7.5 g/cm$^3$ and 8.5 g/cm$^3$. Further, the body density may be between 6 g/cm$^3$ and 7 g/cm$^3$, or between 7 g/cm$^3$ and 8 g/cm$^3$, or between 8 g/cm$^3$ and 9 g/cm$^3$, or between 9 g/cm$^3$ and 10 g/cm$^3$. Specifically, the body density may be 6.0 g/cm$^3$, 6.25 g/cm$^3$, 6.5 g/cm$^3$, 6.75 g/cm$^3$, 7.0 g/cm$^3$, 7.25 g/cm$^3$, 7.5 g/cm$^3$, 7.75 g/cm$^3$, 8.0 g/cm$^3$, 8.25 g/cm$^3$, 8.5 g/cm$^3$, 8.75 g/cm$^3$, 9.0 g/cm$^3$, 9.25 g/cm$^3$, 9.5 g/cm$^3$, 9.75 g/cm$^3$, or 10.0 g/cm$^3$.

Further, in some embodiments, the body and face plate have similar densities. For example, a thin, steel face plate can be coupled to a steel body through the bonding material and retainer. Namely, since the bonding material and retainer hold the club head together, instead of welding, a uniquely thin face plate can be integrated without melting the face plate. By contrast, in conventionally welded club heads, the face plate thickness must be thick enough to withstand the heat applied to the part during welding. Also, since the bonding material structurally supports the face plate, a uniquely thin face plate can be integrated while maintaining durability. By contrast, a flexible polymer used in conventional, filled irons, does not restrict face flexure enough to integrate a substantially thin face plate without sacrificing durability.

In other embodiments, the body and face plate have distinct densities. For example, a discrepancy between the body density and face plate density may exist where the face plate and body are made from different materials. By contrast, conventionally welded golf clubs will comprise substantially similar face and body densities because different materials cannot be readily welded. For example, steel and titanium cannot be readily welded together.

In some embodiments, the body density may be greater than the face plate density. For example, the club head may comprise a steel body, and a titanium face plate. A steel body is conventional. By contrast, a relatively low-density, titanium face plate in combination with a steel body is unique because conventional irons require welding, and steel and titanium cannot be readily welded together. Further, a relatively low-density face plate has less structural mass between the club head perimeter than a conventionally welded iron. Accordingly, co-molding a low-density titanium face plate and steel body improves MOI.

Specifically, the club head 100 further comprises a density ratio, wherein the density ratio is the ratio of the body density to the face plate density. The density ratio may be between 0.33 and 6.66. In some embodiments, the density ratio may be between 1 and 6.66, or between 3 and 6.66, or even between 5 and 6.66. In some embodiments, the density ratio may be between 1 and 2, or between 2 and 3, or between 3 and 4, or between 4 and 5, or between 5 and 6. Specifically, the density ratio may be at least 0.33, 0.5, 1.0, 1.5, 2.0, 2.5, 3.0, 3.5, 4.0, 4.5, 5.0, 5.5, 6.0, or 6.5.

Additionally, the face plate may comprise a substantially high hardness, improving durability. Specifically, improved durability can be characterized by improved groove degradation. This increased durability can be achieved though integrating a face plate formed from a high-hardness material. For example, the face plate may be formed from a metal matrix composite. By contrast, if a high-hardness face plate were integrated into a conventional club head, the body would need to be formed from a material of substantially similar hardness. A high-hardness body, however, may not be preferable because the body is not impacting golf balls. Thus, a high-hardness body, as needed to weld a high-hardness face in a conventional club head, may unnecessarily restrict flexure and may increase structural mass without benefit. The present invention, however, does not require welding the face plate to the body, so a uniquely hard face plate may be paired with a body that can be a different, softer material.

Increased durability may also slow degradation of grooves, providing more consistent spin production. As the grooves on a club head wear, or degrade, the golf ball spin is reduced and ball speed increases. When groove wear is significant, players typically experience increased scores. Namely, reduced spin causes shots to roll off greens, and increased ball speed results in players overshooting their intended landing zone.

For example, in conventional wedges, spin rate decreases approximately 100 RPM for every 500 hits. Accordingly, players may have to replace their wedges within 2 years. Of course, more frequent play, coupled with regular practice, contributes to more frequent replacement. However, increased face plate hardness will decrease the rate of groove degradation, and thereby slow down spin rate losses.

Specifically, the face plate and body each comprise a hardness. In some embodiments, the face plate hardness is greater than the body hardness. In some embodiments, the face plate hardness is between 35 HRC and 62 HRC. In some embodiments, the face plate hardness may be between 35 HRC and 40 HRC, 40 HRC and 45 HRC, 45 HRC and 50 HRC, 50 HRC and 55 HRC, or between 55 HRC and 62 HRC.

In some embodiments, the face plate and body may have substantially similar hardness. For example, a thin, steel face plate can be coupled to a steel body through the bonding material and retainer. While the face plate and body would comprise the same hardness, the thin face plate reduces structural mass and thereby improves MOI. Further, in embodiments where the bonding material and face plate form discrete voids behind the face plate (e.g., FIG. 9A-9D), the thin face can improve ball speed. By contrast, conventional club heads are welded together, so the face plate must be of sufficient thickness to withstand welding temperatures. Accordingly, even where the face plate and body have similar hardness, the present invention may comprise a thinner face plate than conventionally welded club heads.

In other embodiments, the face plate and body have different hardness. For example, a metal matrix composite face plate can be coupled to a steel body through the bonding material and retainer. By contrast, a conventionally welded club head must comprise a face plate and body that can be readily welded together. A metal matrix composite face plate and a steel body cannot be readily welded together. Accordingly, the present invention can comprise a high-hardness face to improve groove degradation, without requiring an unnecessarily hard body. By contrast, to incorporate a high-hardness face plate, a conventional club head would also need a body of similar material properties and thus of similar hardness.

Specifically, the club head may comprise a hardness ratio, which is the ratio of the face plate hardness to the body hardness. The hardness ratio can be between 1 and 3. In some embodiments, the hardness ratio may be between 1 and 1.5, or between 1.5 and 2, or between 2 and 2.5, or between 2.5 and 3. Higher hardness ratios are unique to the present invention. Namely, the hardness ratio in conventional club heads is limited because the face plate and body are welded together. By contrast, in the present invention, the high-hardness face plate may be coupled to a relatively soft body via the bonding material and retainer. Thus, a higher hardness ratio demonstrates that the present invention may protect against groove wear without requiring an unnecessarily hard body.

The integration of a thin, low density, high hardness face plate is possible because the face plate is not welded to the body. Accordingly, the face plate and body can be formed of material that cannot be welded together. Namely, the face plate and body are coupled together by the bonding material and retainer. Specifically, the bonding material engages the face plate and body through the retainer.

Figure 7A:
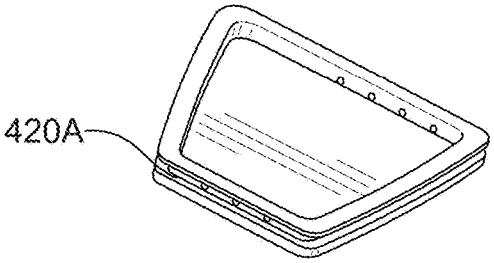
FIG. 7A illustrates a perspective view of a continuous face plate retainer comprising circles within a groove.
Figure 7B:
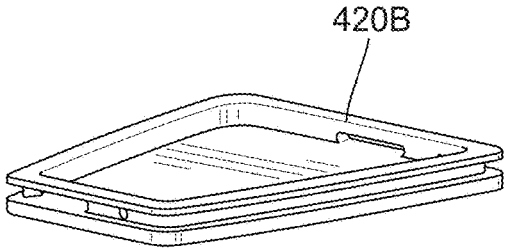
FIG. 7B illustrates a perspective view of a continuous face plate retainer comprising circles and voids within a groove.
Figure 7C:
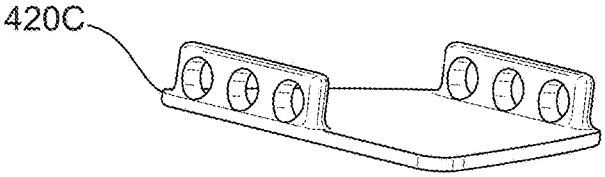
FIG. 7C illustrates a perspective view of a discontinuous face plate retainer tabs and circles.
Figure 7D:
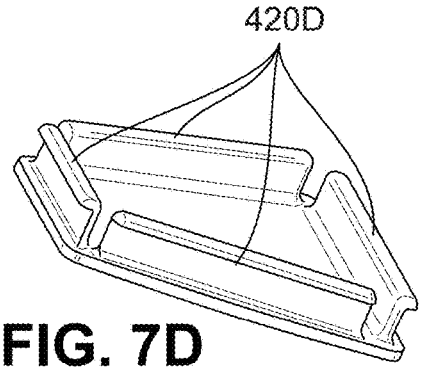
FIG. 7D illustrates a perspective view of a discontinuous face plate retainer exterior hooks.
Figure 7E:
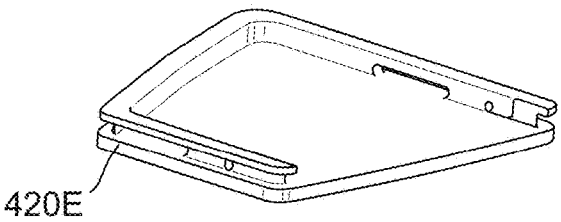
FIG. 7E illustrates a perspective view of a discontinuous face plate retainer comprising circles and voids.
Figure 7F:
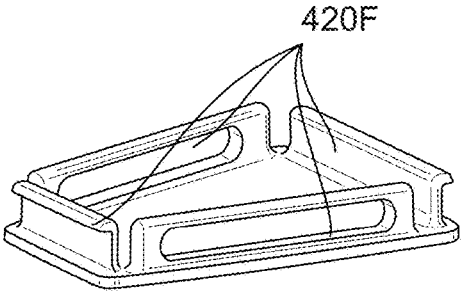
FIG. 7F illustrates a perspective view of a discontinuous face plate retainer comprising exterior hooks and voids.
Figure 7G:
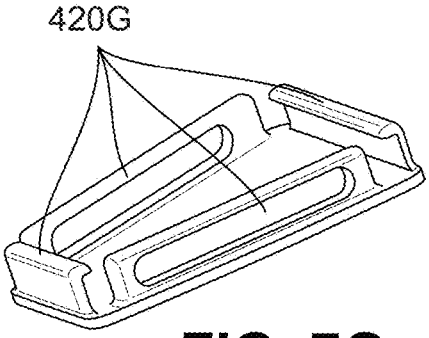
FIG. 7G illustrates a perspective view of a discontinuous face plate retainer comprising interior hooks and voids.
Figure 7H:
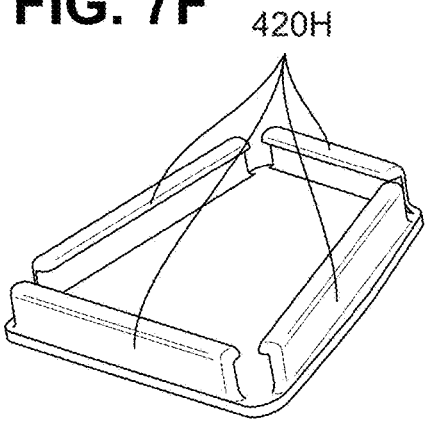
FIG. 7H illustrates a perspective view of a discontinuous face plate retainer comprising interior hooks.

Generally, the retainer 120 provides surface area for the bonding material 115 to engage. Specifically, the bonding material 115 comprises a lobe 125, that engages the retainer. The retainer 120 may be characterized by its cross-sectional geometry. The cross-section of the retainer may comprise a variety of shapes including but not limited to, circles, "L" brackets or hooks, slots, rectangles, ovals, and semi-circles, as shown in FIGS. 7A-H. FIG. The retainer geometry defines the lobe. FIG. 7A illustrates a face plate retainer 420A comprising continuously distributed circular holes within a groove along the face plate perimeter. FIG. 7B illustrates a face plate retainer 420B comprising discretely positioned circular holes or oblong voids within a groove along a face plate perimeter. FIG. 7C illustrates a face plate retainer 420C comprising two D flanges further comprising circular holes. FIG. 7D illustrates a face plate retainer 420D comprising outward facing "L" brackets. FIG. 7E illustrates a face plate retainer 420E comprising a partial groove around the face plate perimeter wherein the groove comprises discretely positioned circular holes or oblong voids. FIG. 7F illustrates a face plate retainer 420F comprising outward facing "L" brackets wherein the outward facing "L" brackets comprise discretely positioned circular holes or oblong voids. FIG. 7G illustrates a face plate retainer 420G comprising inward facing "L" brackets wherein the inward facing "L" brackets comprise discretely positioned circular holes or oblong voids. FIG. 7H illustrates a face plate retainer 420H comprising inward facing "L."

Figure 5A:
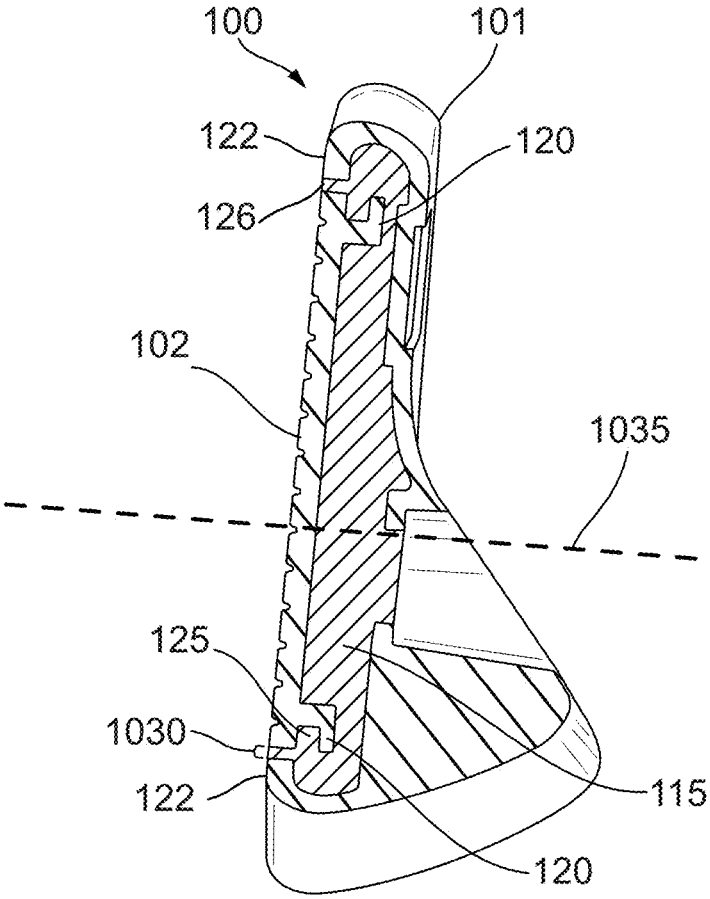
FIG. 5A illustrates a side cross-sectional view of the FIG. 1 golf club head view from the heel.
Figure 5B:
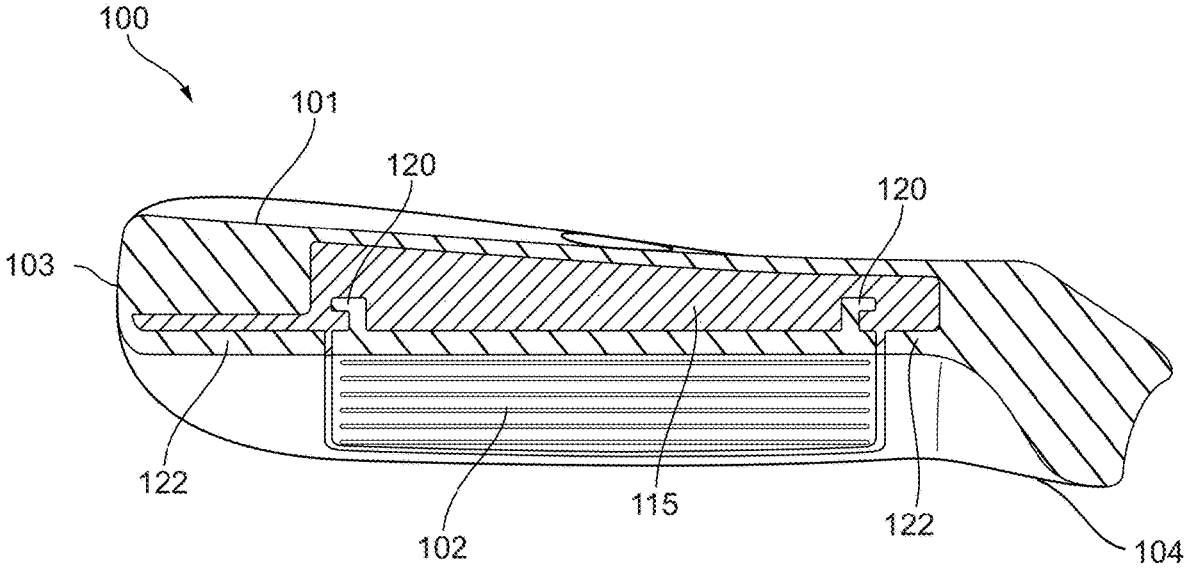
FIG. 5B illustrates a top cross-sectional view of the FIG. 1 golf club.

Referencing FIGS. 2 and 5A, the retainer 120 may be proximate the top rail 109 and sole 111. Also, referencing FIG. 5B, the retainer 120 may be proximate the heel end 104 and proximate the toe end 103. With continued reference to both FIGS. 5A and 5B, the body 101 also may comprise one or more retainers 122. The one or more body retainers may be located at the heel end 104, the toe end 103, the top rail 109, or the sole 111. In some embodiments, the one or more body retainers 122 may be characterized by an undercut. In other embodiments, the one or more body retainers 122 may be similar to aforementioned face plate retainer geometry.

In addition to the at least one retainer, the face plate 102 and body 101 are engaged by a lip 126, wherein the lip 126 is a region of the bonding material 115 between the face plate 102 peripheral edges, and the frame 119. Namely, the lip 126 may be adjacent the sole 111, adjacent the heel end 104, adjacent the toe end 103, or adjacent the top rail 109. Further, the lip 126 may form a portion of the sole 111, toe 103, or top rail 109.

In some embodiments, the lip is adjacent the top rail, sole, heel, and toe. Further, in such embodiments, the lip does not form any part of the sole, top rail, or toe. For example, as shown in FIG. 1, the lip 115 wraps around the strike face 112.

In other embodiments, the lip forms part of the top rail 109, part of the sole 111, or part of the toe 103. Namely, the face plate 102 may form a portion of the sole 111, toe 103, or top rail 109. Accordingly, in these embodiments, the lip would be visible on the sole 111, toe 103, or top rail 109. In such embodiments, where the face plate 102 forms a portion of the sole 111, toe 103, or top rail 109, ball speed can be uniquely improved. For example, the face plate 102 may extend to form a portion of the top rail 109. Also, the club head may comprise a discrete void (e.g., FIGS. 9A-9D) proximate the sole 111 formed by the bonding material 115 and face plate 102. By extending the face plate 102 into the top rail 109, the distance between the discrete void proximate the sole 111, and top edge of the face plate is increased relative to embodiments where the face plate does not form a portion of the top rail. Therefore, a ball strike proximate the discrete void will generate greater face flexure near the discrete void and will thus result in increased ball speed.

Specifically, in some embodiments, the lip is adjacent the heel end 104, toe end 103, and top rail 109, and form part of the sole 111. In further embodiments, the lip is adjacent the heel end 104, toe end 103, and sole 111, and form part of the top rail 109. In further embodiments, the lip is adjacent the heel end 104, sole 111, and top rail 109, and form part of the toe end 103. In some embodiments, the lip is adjacent the heel end 104 and toe end 103, and form part of the top rail 109 and part of the sole 111. In further embodiments, the lip is adjacent the heel end 104 and sole 111, and form part of the top rail 109 and toe end 103. In further embodiments, the lip is adjacent the heel end 104 and top rail 109, and form part of the sole 111 and toe and 103. In some embodiments, the lip is adjacent the heel end 104, and form part of the top rail 109, sole 111, and toe end 103.

The club head 100 may further comprise a face plane 1015, and an offset 1030, wherein the face plane 1015 is parallel to, and coplanar with, the face plate 102, and the offset 1030 is the distance between the face plate 102 and body 101, measured along the face plane 1015. The offset 1030 may be constant across the face plate 102, or can vary. Further the offset 1030, defines the lip. The offset distance may be between 0.001 inch and 0.125 inch. For aesthetics, the offset distance is preferably minimized.

The retainer and lip, in all their variations, facilitate a secure connection between the bonding material 115, face plate 102, and body 101. However, the bonding material 115 is also a high strength component. Thus, the bonding material 115 provides substantial structural support.

Accordingly, the structural support provided by the bonding material 115 allows for a uniquely thin face plate 102 that facilitates MOI and ball speed improvements. Specifically, the face plate 102 comprises a thickness, wherein the face plate thickness is measured orthogonal to the face plane. Additionally, the face plate 102 can comprise a variable thickness profile. For example, the maximum thickness of the face plate 102 can be positioned at a central region, with a minimum thickness positioned at a perimeter region of the face plate 102. The variable thickness profile can improve characteristic time or ball speed.

Relative to the art, the face plate 102 in the present invention may be thin. Specifically, the face plate thickness may be between 0.02 inches and 0.125 inches. In one exemplary embodiment, the face plate thickness is 0.04 inches.

A thin face plate reduces structural weight between the club head perimeter. Accordingly, a thin face plate fundamentally increases MOI, and also provides more discretional mass to further increase MOI and improve center of gravity. Conventionally welded club heads, however, must have sufficient face thickness to withstand welding temperatures. Even conventional, filled irons, are limited in thinning the face plate. Namely, conventional, filled irons, are filled with a material that is softer than in the present invention, allowing face flexure and not providing the same degree of structural support. Further, conventional filled irons require that the face plate and body are welded together. Accordingly, relative to conventionally welded club heads, the present invention may comprise a uniquely thin face plate, supported by the bonding material, that improves MOI. Additionally, because of the uniquely thin face plate, the present invention may comprise a CG that is lower and more rearward than in conventionally welded club heads.

By improving MOI, a thin face plate also produces improved ball speed for off-center hits. Specifically, a higher MOI club head demonstrates more consistent ball speed. Further, a thin face plate paired with discrete voids formed by the bonding material and face plate can further improve ball speed. Specifically, a thin face plate increases flexibility and contact time, thereby increasing ball speed relative to conventionally welded club heads where the face plate cannot be as thin because the face plate must withstand welding temperatures.

Namely, as discussed in more detail below, the bonding material supports the face plate. However, the bonding material 115 does not necessarily support the face plate 102 continuously. For example, referring to FIGS. 9A-9D, the club head 700A-D can comprise at least one discrete void 714A-D between the face plate 702A-D and bonding material 715A-D. The bonding material 715A-D and retainer still hold the club head 700A-D together, and the bonding material still supports the face plate 702A-D. The at least one discrete void 714A-D, however, allows localized face plate 702A-D flexure and can be tailored to dead spots on the face.

Figure 9A:
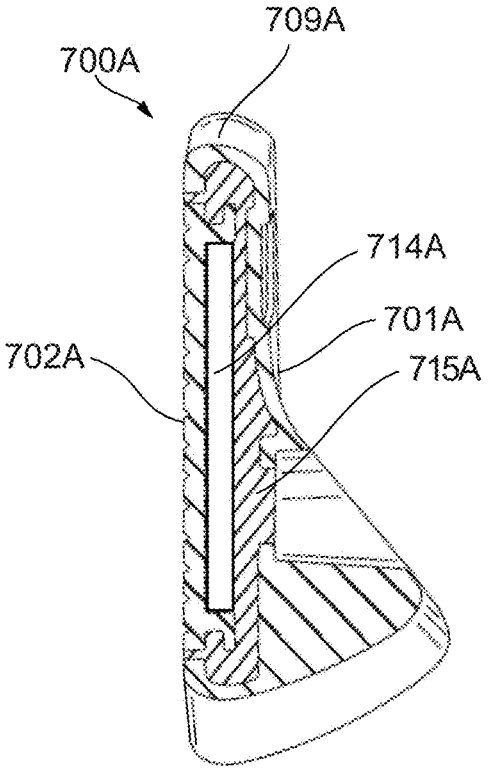
FIG. 9A illustrates a golf club head comprising at least one discrete void according to the present invention.
Figure 9B:
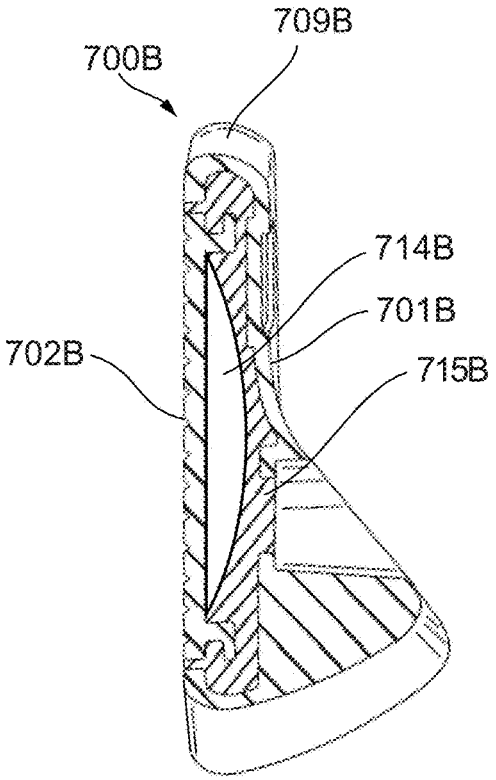
FIG. 9B illustrates a golf club head comprising at least one discrete void according to the present invention.
Figure 9C:
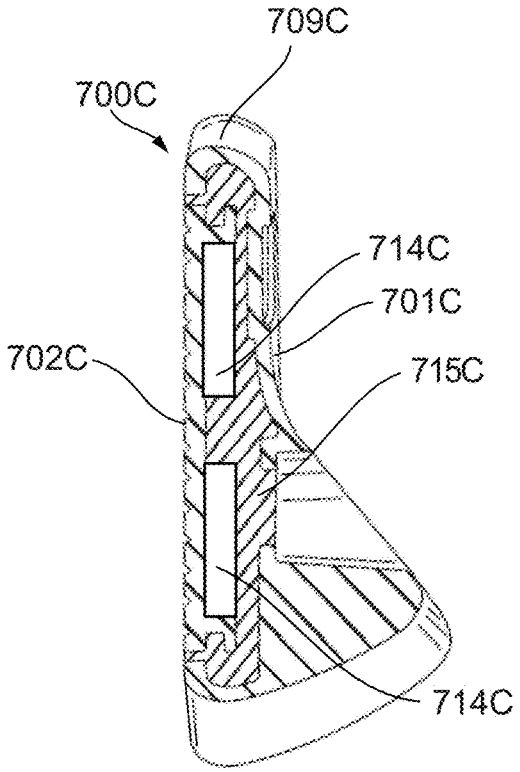
FIG. 9C illustrates a golf club head comprising at least one discrete void according to the present invention.
Figure 9D:
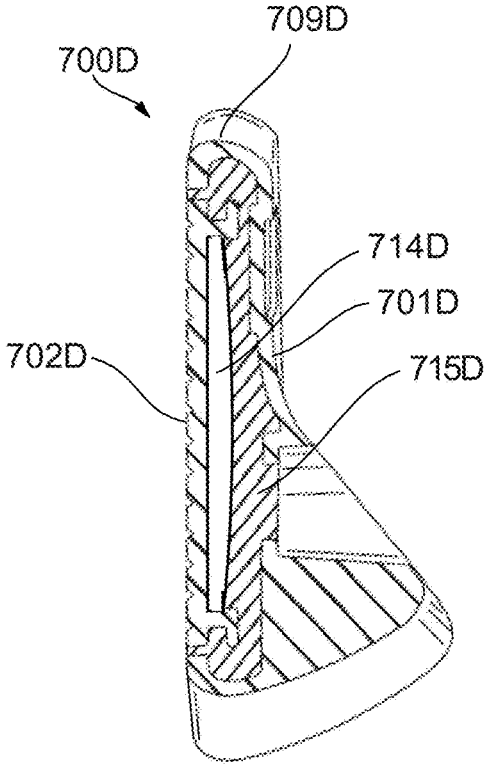
FIG. 9D illustrates a golf club head comprising at least one discrete void according to the present invention.

In some embodiments, like FIG. 9C, the club head 700C comprises discrete voids 714C away from the face plate 702C center, near the heel end and toe end. Encouraging localized face plate 702C flexure near the heel end and toe end increases ball speed for strikes near the heel end and toe end, respectively. In another embodiment, the club head comprises a single discrete void positioned near the toe end and top rail. Encouraging localized flexure in the high toe region improves ball speed for strikes near the high toe region. Specifically, at least one discrete void can be placed near the heel end, toe end, top rail, or sole, or any combination therein.

The MOI and ball speed benefits associated with a light, thin, face are made possible by the substantial support provided by the bonding material. Specifically, the bonding material has substantial compressive strength and thickness. For example, in some embodiments, the bonding material has a compressive strength of 80 Ksi. Further, the bonding material extends between the face plate and body and is thus substantially thick in the direction of impact. Accordingly, the bonding material as an overall component, has a high compressive strength.

As a result, the bonding material dominates bending stress. Therefore, where the bonding material directly supports the face, face plate bending is limited. Since face plate flexure is limited by direct contact with the bonding material, a thin face plate can be integrated without sacrificing club head durability.

Specifically, the bonding material may comprise a thermoplastic resin and a plurality of discontinuous fibers. One suitable thermoplastic resin may include a thermoplastic polyamide (e.g., PA6 or PA66), and it may be filled with chopped carbon fiber (i.e., a carbon-filled polyamide). Other resins may include certain polyimides, polyamide-imides, polyphenylene sulfides (PPS), polyetheretherketones (PEEK), polycarbonates, engineering polyurethanes, and/or other similar materials. Additional acceptable resins include nylon 11 (PA-11), nylon 12 (PA-12), polycarbonate (PC), polyetherimide (PEI), polyethylenimine (PEI), thermoplastic polyurethane (TPU), polymethylpentene (TPX), polyvinylidene fluoride (PVDF), Acrylonitrile butadiene styrene (ABS), Polybutylene terephthalate (PBT), Polyethylene (PE), Polyoxymethylene (POM), Polypropylene (PP), Polystyrene (PS), and polymethyl methacrylate (PMMA).

The resin is reinforced by fibers. The fibers may The discontinuous/chopped fibers may include, for example, chopped carbon fibers or chopped glass fibers that are embedded within the resin prior to molding the front body 12. While possible material configurations will be discussed further below, in one configuration, the polymeric material may be a "long fiber thermoplastic" where the discontinuous fibers are embedded in a thermoplastic resin and each have a designed fiber length of from about 3 mm to about 25 mm. In an exemplary embodiment, the 12.7 mm fibers are used. In another configuration, the polymeric material may be a "short fiber thermoplastic" where the discontinuous fibers are similarly embedded in a thermoplastic resin, though each may have a designed length of from about 0.01 mm to about 3 mm. In either case, it should be noted that those lengths are the pre-mixed lengths, and due to breakage during the molding process, some fibers may actually be shorter than the described range in the final component. In some configurations, the discontinuous chopped fibers may be characterized by an aspect ratio (e.g., length/diameter of the fiber) of greater than about 10, or more preferably greater than about 50, and less than about 1500. Regardless of the specific type of discontinuous chopped fibers used, in certain configurations, the material may have a fiber length of from about 0.01 mm to about 12 mm and a resin content of from about 40% to about 90% by weight, or more preferably from about 55% to about 70% by weight.

In some embodiments, the discontinuous fibers account for between 5% and 50% of the bonding material volume. The bonding material may comprise between 5% and 20%, or between 20% and 35%, or between 35% and 50% fiber by volume. Specifically, the bonding material may comprise 5%, 10%, 15%, 20%, 25%, 30%, 35%, 40%, 45%, or 50% fiber by volume. In an exemplary embodiment, the bonding material comprises a TPU resin reinforced by 12.7 mm long carbon fiber, wherein the bonding material is 40% carbon fiber by volume, and 60% TPU by volume.

While described in more detail with the manufacturing process, co-molding the face plate and body through the bonding material and retainer allows for a higher fiber concentration than conventional filled irons. Specifically, conventional filled irons typically require injecting polymer into the club head cavity after the face plate and body are welded together. By contrast, in the present invention, the face plate and body are co-molded. During the co-molding process, excess bonding material may pass through the offset between the face plate and body prior to curing. Specifically, the offset 1030 may act as a strainer that allows the resin to readily pass through, but not the fibers. Alternatively, the club head may comprise slits to that allow resin to pass through the club head and thus increase the fiber concentration. Accordingly, the present invention may comprise a uniquely high fiber concentration, and thus may comprise uniquely high strength over conventionally welded club heads.

In some embodiments, the bonding material may comprise continuous fibers, wherein the aspect ratio is greater than 1500. Generally, continuous fibers can provide increased strength relative to discontinuous fibers. However, continuous fibers are less conducive to forming intricate, or tightly curved, geometries. Accordingly, in some embodiments, discontinuous and continuous fibers may be used. For example, discontinuous fibers may be used around tight corners, while continuous fibers are used in relatively uniform sections.

Further, the bonding material has substantially high compressive strength. Specifically, the bonding material may have a compressive strength between 10 ksi and 100 ksi. Preferably, the bonding material has a compressive strength between 50 and 100 ksi. In some embodiments, the bonding material compressive strength is between 50 and 60 ksi, or between 60 and 70 ksi, or between 70 and 80 ksi, or between 80 and 90 ksi, or between 90 and 100 kis. The bonding material's substantially high compressive strength ensures club head durability despite regions where the bonding material is thin. For example, viewing FIG. 5A, the bonding material 115 is substantially thin near the lowest portion of the retainer 120. This thin region is more susceptible to failure than the other portions of the bonding material 115 because there is less bonding material 115 supporting the face plate 102. However, the high compressive strength of the bonding material 115 ensures such thin regions do not fail under repeated dynamic loading.

In addition to the underlying material compressive strength, the bonding material 115, as a complete component, resists compression because it comprises a substantial amount of the club head volume. Specifically, since the bonding material 115 extends between the face plate 102 and body 101, it has substantial thickness in the direction of impact. In some embodiments, the bonding material 115 comprises a minimum thickness between 0.025 inches and 0.050 inches, and a maximum thickness between 0.25 inches and 0.5 inches.

Generally, the bonding material may comprise between approximately 20% and 35% of the club head volume. The club head volume, however, includes the body, face plate, and bonding material. Accordingly, the bonding material may comprise all the available volume between the rear body and face plate. For example, referring to FIGS. 2 and 5, the bonding material 115 fills the entire cavity between the body 101 and face plate 102.

Alternatively, the club head can comprise discrete voids, wherein the bonding material does not fill the entire cavity. Instead, the bonding material and face plate form discrete voids behind the face plate. For example, referring to FIGS. 9A-D, there are discrete voids 709A-D inside the club head 700A-D where the bonding material 715A-D is spaced from the face plate 702A-D.

By comprising substantially high compressive strength, the bonding material reduces the bending stress experienced by the body, including the top rail and sole. Reducing the bending stress applied to the body removes structural demands on the body. Accordingly, the body can be substantially thin relative to conventionally welded club heads. For example, the body can have a the top rail 109 and rear surface 110 thickness may be 0.03 inch. By contrast, conventionally welded club heads comprise a top rail and rear surface thickness of approximately 0.05 inch.

Further, the club head body's resulting rigidity limits face plate flexure. Accordingly, stresses applied to the face plate are also minimized, improving durability. Ultimately, the bonding material's high compressive strength allows for the durable integration of unique material differences between the face plate and body materials to improve club head performance. For example, since the bonding material absorbs the majority of bending stress applied to the club head, the face plate can be substantially thinner than in conventionally welded clubs while at least maintaining durability.

While these unique and advantageous face plate properties are facilitated by the high compressive strength and toughness of the bonding material, the bonding material also independently contributes to improved performance. Namely, since the bonding material is surrounded by the body, the bonding material can comprise a substantially low density relative to metals that traditionally fill club head interiors. Specifically, since the bonding material is surrounded by the club head body, the bonding material experiences little tensile stress. Accordingly, the bonding material is predominantly managing only compressive force. Without having to be substantially strong in tension and compression, the bonding material may be sufficiently durable, while also providing substantial weight savings. A low-density bonding material removes structural mass between the club head perimeter. Accordingly, MOI is fundamentally increased relative to a similar club head that is forged or cast. Additionally, a club head comprising a low-density bonding material has more discretionary mass which can further improve MOI and CG.

Specifically, the bonding material density may be between 0.85 g/cm$^3$ and 1.75 g/cm$^3$. By contrast, steel has a density of approximately 8 g/cm$^3$ and aluminum has a density of approximately 2.7 g/cm$^3$. In some embodiments, the bonding material density may be between 1 g/cm$^3$ and 1.60 g/cm$^3$, or even between 1.15 g/cm$^3$ and 1.45 g/cm$^3$. Further, the bonding material may be between 0.85 g/cm$^3$ and 1.0 g/cm$^3$, or between 1.0 g/cm$^3$ and 1.15 g/cm$^3$, or between 1.15 g/cm$^3$ and 1.3 g/cm$^3$, or between 1.3 g/cm$^3$ and 1.45 g/cm$^3$, or between 1.45 g/cm$^3$ and 1.6 g/cm$^3$, or between 1.6 g/cm$^3$ and 1.75 g/cm$^3$. Specifically, the bonding material density may be 0.85 g/cm$^3$, 0.9 g/cm$^3$, 0.95 g/cm$^3$, 1.0 g/cm$^3$, 1.05 g/cm$^3$, 1.10 g/cm$^3$, 1.15 g/cm$^3$, 1.20 g/cm$^3$, 1.25 g/cm$^3$, 1.3 g/cm$^3$, 1.35 g/cm$^3$, 1.4 g/cm$^3$, 1.45 g/cm$^3$, 1.5 g/cm$^3$, 1.55 g/cm$^3$, 1.60 g/cm$^3$, 1.65 g/cm$^3$, 1.7 g/cm$^3$, 1.75 g/cm$^3$, 1.8 g/cm$^3$, or 1.85 g/cm$^3$. The bonding material density, along with the discretionary mass gained from a thin, low density face plate provides discretionary mass that can increase club head MOI and place the club head CG preferentially.

As discussed, using the bonding material to hold the club head together, instead of welding, produces distinct performance benefits. Separately discussed, the structural support provided by the bonding material also produces distinct performance benefits. However, these distinct benefits are not mutually exclusive. Rather, both features complement each other.

Specifically, a low-density, thin, face plate reduces structural mass between the club head perimeter. Also, the low-density bonding material further reduces structural mass between the cub head perimeter. Together, the low-density, thin, face plate and the low density-bonding material provide increased discretionary mass. Namely, the face plate and internal cavity are located proximate the club head center. Thus, reducing the mass of each removes mass from the center of the club head. For example, a titanium face plate and thermoplastic bonding material may be used in place of steel. While steel has a density of approximately 8 g/cm$^3$, titanium has a density of approximately 4 g/cm$^3$, and the thermoplastic bonding material may have a density of approximately 2 g/cm$^3$. Thus, MOI is fundamentally improved. For example, a club head comprising a titanium face plate and thermoplastic bonding material may have an MOI that is approximately 15% greater than a similar, conventionally welded, steel club head. Additionally, discretionary mass is increased. The discretionary mass can be moved elsewhere in the club to improve MOI and CG. For example, the discretionary mass can be placed into at least one of the weighting features described below.

Figure 8A:
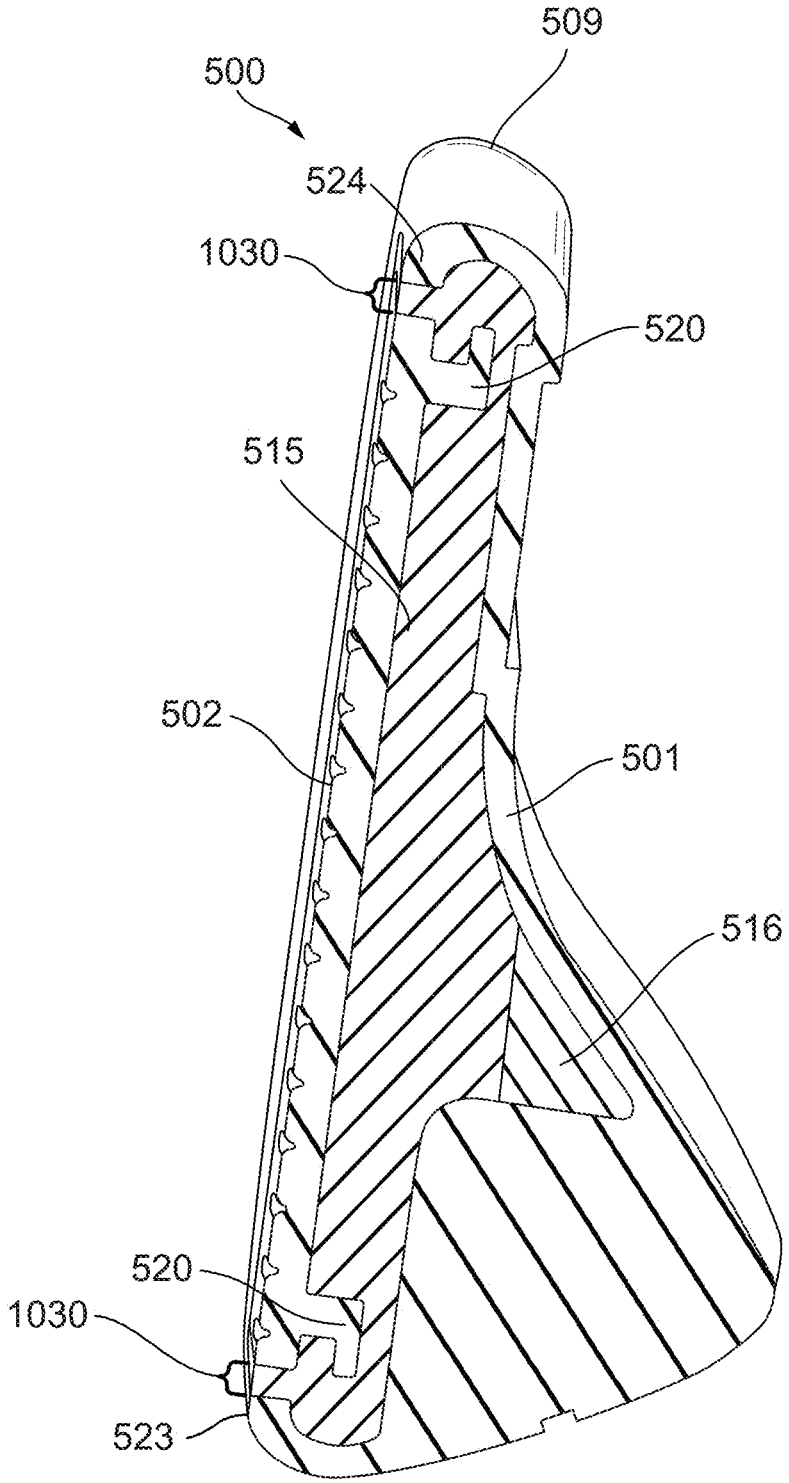
FIG. 8A illustrates a side cross-sectional view of a golf club head comprising an internal weight, according to the present invention.

In addition to the bonding material, retainer, face plate, and body, the club head also may comprise a discretionary weight system. Referring to FIG. 8A, the club head 500 may comprise a at least one weighting features. The weighting features may be located within the bonding material 515 as an internal weight 516 or within the toe end of the club head 500. Unlike conventional polymer filled irons, the internal weight 516 is not removable to provide a port for injecting polymer. Specifically, in the present invention, the face plate 502 and body 501 are co-molded. By contrast, conventionally filled irons include a welded face plate and body, and polymer that is injected into the cavity formed by the welded face plate and body.

Figure 8B:
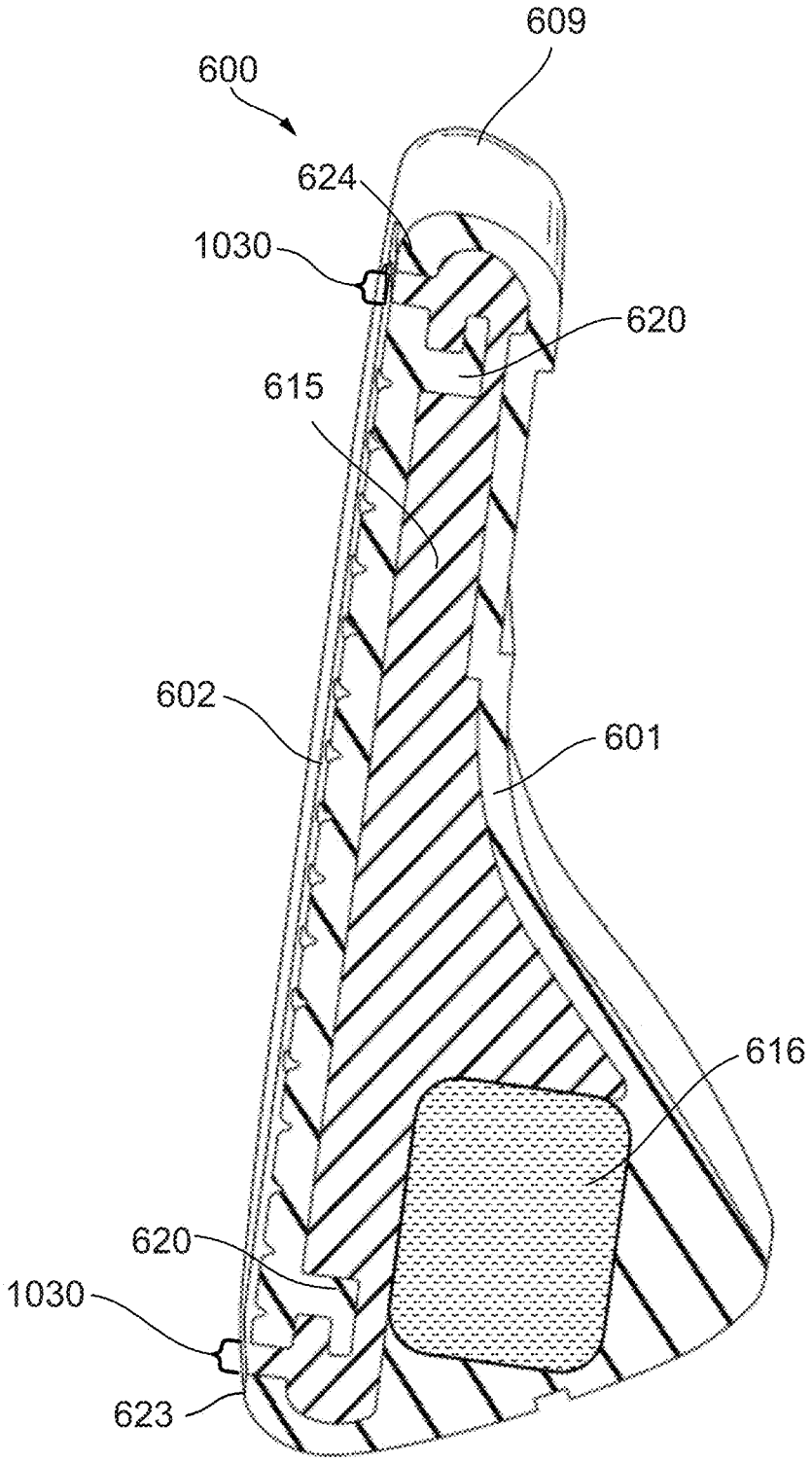
FIG. 8B illustrates a side cross-sectional view of a golf club head comprising an internal weight, according to the present invention.

In some embodiments, the club head 500 comprises one or more internal weights 516 embedded within the bonding material 515, wherein the one or more internal weights 516 are disposed within the club head volume. With reference to FIG. 8B, an exemplary embodiment of a golf club head 600 comprising one or more internal weights 616 is depicted. The golf club head 600 comprises a face plate 602, a retainer 620, a body 601, an internal cavity 606 and a top rail 609. In this embodiment the one or more internal weights are located in the internal cavity 616 mid portion proximate a club head rear and club head sole. The one or more internal weights 616 may be positioned in the internal cavity heel end, toe end, or both the heel end and the toe end. Accordingly, the placement of the one or more internal weights 616 alters the MOI and CG properties of the club head 600.

The one or more internal weights 516 or 616 may comprise a high-density material, such as Tungsten. In some embodiments, the one or more internal weights 516 or 616 contact an inner portion of the body 501 or 601 and do not contact the face plate 502 or 602.

The one or more internal weights 516 or 616 further may comprise a weight retainer 520 or 620 to securely engage the bonding material 515 or 615. By embedding the one or more internal weights 516 or 616 within the bonding material 515 or 615, several restrictions that would otherwise be imposed on the one or more internal weights 516 or 616 are removed. For example, in some embodiments, the one or more internal weights 516 or 616 are not welded to the body 501 or 601. Further, while internal weights typically require precision fitting for secure, and durable, attachment, the one or more internal weights 516 or 616 of the present invention may be roughly formed because they are embedded within the bonding material 515 or 615. The rough internal weight formation and minimal direct attachment to the body 501 or 601 reduces production time and club head mass yet maintains durability because of the reinforcement provided by the bonding material 515 or 615.

Additionally, embedding the one or more internal weights 516 or 616 in the bonding material mitigates potential rattling that may cause undesirable sound. Specifically, any movement of the one or more internal weights 516 or 616 is substantially restricted by the bonding material and body 501 or 601.

The internal weight 516 or 616 may be positioned and sized to improve forgiveness. For example, a low and toe-ward internal weight 516 or 616 may significantly lower the club head center of gravity and shift the center of gravity toe-ward, which is known in the art to improve club head MOI. The one or more internals weight 516 or 616 may have a mass between 10 grams and 40 grams.

The internal cavity 506 or 606 may comprise one or more internal weights 516. In some embodiments, there may be one internal weight, two internal weights, three internal weights, four internal weights or more than four internal weights. The one or more internal weights 516 or 616 may be equally spaced from each other within the bonding material 515 or 615. The one or more internal weights 516 or 616 do not touch the face plate 502 or 602. The one or more internal weights 516 or 616 may touch the body 501 or 601 either at the toe end, heel end, or rear end 510 or 610.

The one or more internal weights 516 or 616 can comprise a generally triangular cross-sectional shape. In other embodiments, the cross-section of the one or more internal weights can be rectangular, circular, semi-circular, polygonal, or any other suitable shape. Namely, since the one or more internal weights 516 or 616 are embedded in the bonding material 515 or 615, they do not need to be welded in place, and therefore the internal weight 516 or 616 shape is not structurally critical. Instead, a variety of shapes may be used to achieve desirable CG positions and MOI improvement. By contrast, internal weights in conventionally welded clubs are limited to shapes that provide adequate surface area for welding.

In further embodiments, the golf club head may comprise a toe screw weight located within a toe screw weight port. The toe screw weight port may comprise a cylindrical recess with an exterior opening and a cylindrical sidewall. The toe screw weight port may further comprise grooves around at least a portion of the cylindrical sidewall, with the grooves being configured to receive the threads of the toe screw weight and secures the toe screw weight in place.

In some embodiments, the toe screw weight comprises a mass within a range of about 1 to 20 grams. In some embodiments, the mass of the toe screw weight can be between about 1 and 2 grams, between about 2 and 3 grams, between about 3 and 4 grams, between about 4 and 5 grams, between about 5 and 6 grams, between about 6 and 7 grams, between about 7 and 8 grams, between about 8 and 9 grams, between about 9 and 10 grams, between about 10 and 11 grams, between about 11 and 12 grams, between about 12 and 13 grams, between about 13 and 14 grams, between about 14 and 15 grams, between about 15 and 16 grams, between about 16 and 17 grams, between about 17 and 18 grams, between about 18 and 19 grams, or between about 19 and 20 grams.

As discussed, the combination of the face plate, bonding material, retainers, and body facilitates discretionary weighting that can achieve desirable CG positions and improved MOI. Namely, a low and back CG is generally desirable.

Specifically, the CG depth can range from 0.080 to 0.110 inches. The CG depth is measured from the XYZ coordinate system 1035 origin, positioned at the geometric center of the strike face. The CG depth can be 0.080 inches, 0.082 inches, 0.084 inches, 0.086 inches, 0.088 inches, 0.090 inches, 0.092 inches, 0.094 inches, 0.096 inches, 0.098 inches, 0.100 inches, 0.105 inches, or 0.110 inches.

Further, a sole-top rail CG height can be defined as a vertical distance between the XYZ coordinate system 1035 origin and the CG. The sole-top rail CG height can range from 0.450 to 0.600 inch. The CG height can be less than 0.600 inch, less than 0.590 inch, less than 0.580 inch, less than 0.570 inch, less than 0.560 inch, less than 0.550 inch, less than 0.545 inch, less than 0.540 inch, less than 0.535 inch, less than 0.530 inch, less than 0.525 inch, less than 0.520 inch, less than 0.515 inch, less than 0.510 inch, less than 0.505 inch, less than 0.500 inch, or less than 0.450 inch.

Further, moments of inertia exist about the x-axis Ixx (i.e. top rail-to-sole moment of inertia), about the y-axis Iyy (i.e. heel-to-toe moment of inertia) and about the z-axis (i.e., strikeface to rear). In many embodiments, the golf club head comprises a top rail-to-sole moment of inertia, Ixx, from 95 $g \cdot in^2$ to 150 $g \cdot in^2$. In many embodiments, the golf club head comprises a top rail-to-sole moment of inertia Ixx greater than approximately 95 $g \cdot in^2$, greater than approximately 98 $g \cdot in^2$, greater than approximately 100 g·in, greater than approximately 102 $g \cdot in^2$, greater than approximately 103 $g \cdot in^2$, greater than approximately 104 $g \cdot in^2$, greater than approximately 105 $g \cdot in^2$, greater than approximately 106 $g \cdot in^2$, greater than approximately 110 $g \cdot in^2$, greater than approximately 115 $g \cdot in^2$, greater than approximately 120-$g \cdot in^2$, greater than approximately 125 $g \cdot in^2$, greater than approximately 130 $g \cdot in^2$, greater than approximately 135 $g \cdot in^2$, greater than approximately 140 $g \cdot in^2$, greater than approximately 145 $g \cdot in^2$, or greater than approximately 150 $g \cdot in^2$.

Further, in many embodiments, the golf club head comprises a heel-to-toe moment of inertia Iyy, which may be greater than approximately 350 $g \cdot in^2$, greater than approximately 360 $g \cdot in^2$, greater than approximately 370 $g \cdot in^2$, greater than approximately 380 $g \cdot in^2$, greater than approximately 390 $g \cdot in^2$, greater than approximately 400 $g \cdot in^2$, greater than approximately 410 $g \cdot in^2$, greater than approximately 420 $g \cdot in^2$, greater than approximately 430 $g \cdot in^2$, greater than approximately 440 $g \cdot in^2$, greater than approximately 450 $g \cdot in^2$, greater than approximately 460 $g \cdot in^2$, greater than approximately 470 $g \cdot in^2$, greater than approximately 480 $g \cdot in^2$ or greater than approximately 490 $g \cdot in^2$. In many embodiments, the golf club head comprises a heel-to-toe moment of inertia Iyy from 420 $g \cdot in^2$ to 490 $g \cdot in^2$.

Further, the club head comprises a strikeface to rear moment of inertia Izz, which may be greater than approximately 400 $g \cdot in^2$, greater than approximately 410 $g \cdot in^2$, greater than approximately 420 $g \cdot in^2$, greater than approximately 430 $g \cdot in^2$, greater than approximately 440 $g \cdot in^2$, greater than approximately 450 $g \cdot in^2$, greater than approximately 460 $g \cdot in^2$, greater than approximately 470 $g \cdot in^2$, or greater than approximately 480 $g \cdot in^2$. In many embodiments, the golf club head comprises a strikeface to rear moment of inertia Izz can range from 400 $g \cdot in^2$ to 450 $g \cdot in^2$ Combining the described features (e.g., thin, low density, hard, face plate) may be achieved through a unique co-molding manufacturing process. Specifically, while conventional clubs require welding the face plate and body, the present invention may be formed by co-molding the face plate and body through the bonding material and retainers. Even conventional, polymer filled irons require welding the face plate and body together, and then injecting polymer through a port.

Accordingly, to facilitate successful construction, the club head may comprise gates, flow leaders, and voids that help guide the bonding material. Namely, during a molding process, such as injection molding, embedded fibers tend to align with the direction of the flowing polymer. With some fibers and resins, the alignment tends to occur more completely close to the walls of the mold or edge of the part. Placement of gates, flow leaders, and voids within the mold design may direct flow in such a manner to control fiber orientation in more complex ways. Doing so may enable non-uniform fiber orientation that may, for example, arc/bend, converge, diverge/fan out, and the like. For example, the flow leaders may direct flow toward the retainer.

Figure 18:
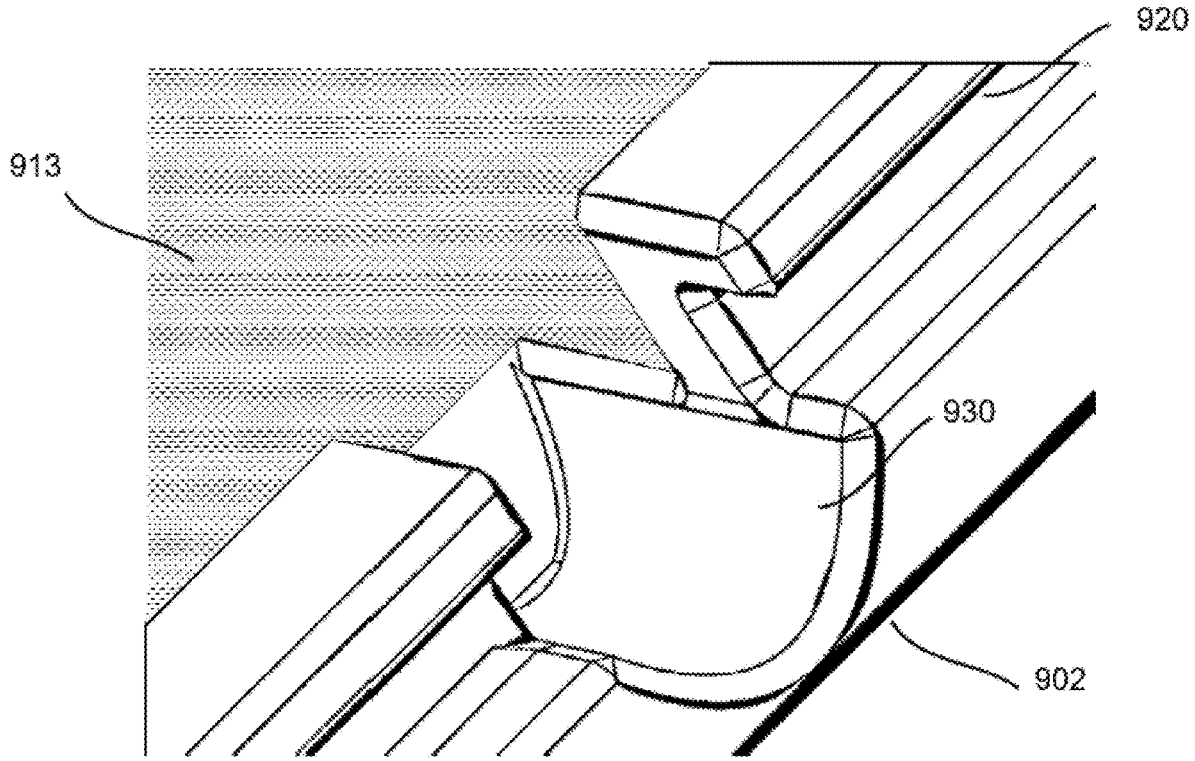
FIG. 18 illustrates a perspective view of a face plate comprising a flow leader according to the present invention.

Referring to FIG. 18, the face plate can comprise a flow leader 930. In some embodiments, the face plate comprises one or more flow leaders 930. The flow leaders 930 aid in directing the flow of the bonding material 915 in the co-molding process. In some instances, the flow leaders 930 ensure the fibers of the bonding material 915 align in a specific direction. The necessary direction of the fibers is dependent on the stress distribution within the bonding material 915. The direction can be horizontal, vertical, or at an angle relative to the ground plane between 0 and 90 degrees. The flow leaders 930 can be recessed within the face plate 902 to form channels. In other embodiments, the one or more flow leaders 930 are located around a perimeter of the face plate 902. In some embodiments, the face plate 902 comprises 6 flow leaders 930 equally spaced around the perimeter of the face plate 902. In other embodiments, the face plate comprises 4 flow leaders 930. Specifically, the first flow leader may be located on a toe portion of the face plate perimeter, the second flow leader may be located on a top portion of the face plate perimeter, the third flow leader may be located on a heel portion of face plate perimeter, and the fourth flow leader may be located on a sole portion of the face plate perimeter.

The flow leaders 930 comprise a width, a depth, and a length. The width can be between 0.1 inch to 2 inches. The depth can be between 0.1 inch to 1 inch. The length can be between 0.1 inch to 2 inches. The flow leaders may comprise various geometries including, a polygon, a rectangular prism, a half cylinder, a rectangular prism with radiused corners, and similar shapes. The various geometries are advantageous in different applications for dispersing the filler material throughout the club head.

Figure 6:
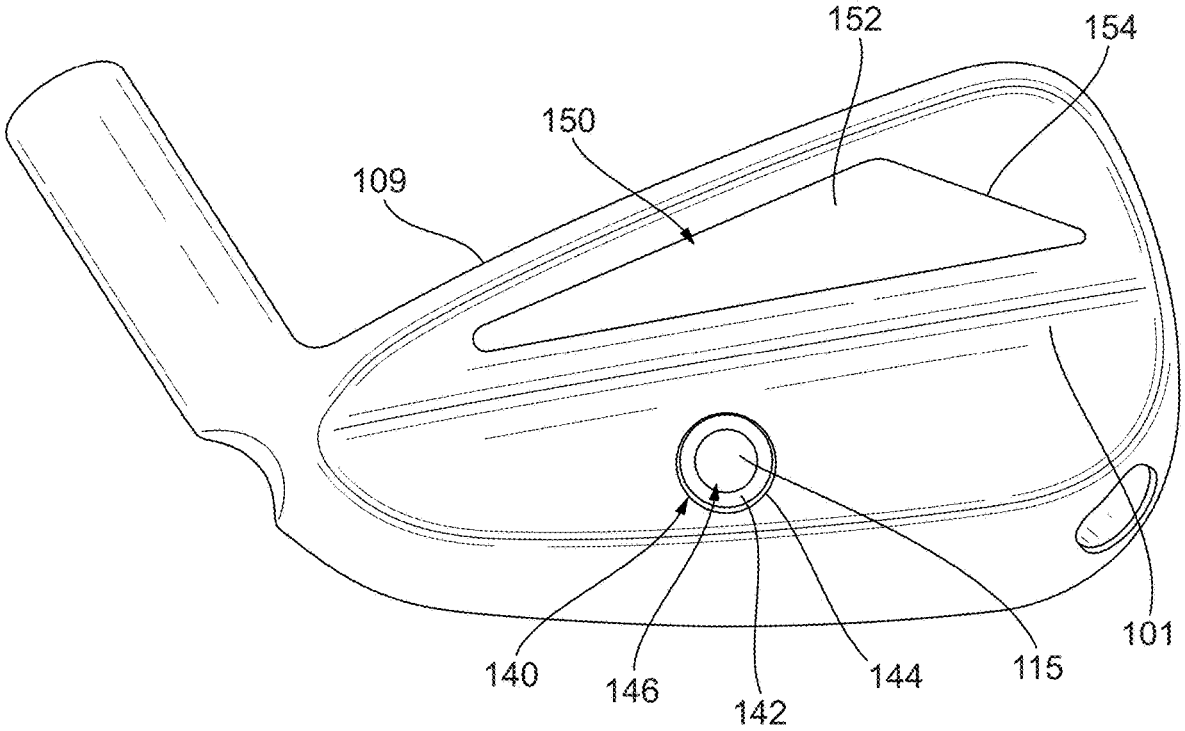
FIG. 6 illustrates a rear view of the FIG. 1 golf club head.

Illustrated in FIG. 6, the gate 140 can be positioned in a central region on the back surface of the body 101 and is recessed towards the face plate 102 but does not touch the face plate 102. In other embodiments, the gate 140 can be positioned in a heel end 104 or a toe end 103. In a preferred embodiment, there is one gate 140 centrally located. In further embodiments, there can be one or more gates (not shown) positioned around the back surface of the body 101.

The gate 140 can comprise a generally circular shape. In other embodiments, gate 140 can comprise a rectangular, triangular, polygonal, or any other suitable shape. The gate 140 can comprise a diameter. In some embodiments, the gate diameter can be between 0.15 inch and 0.35 inch. In some embodiments, the gate diameter can be between 0.15 inch to 0.17 inch, 0.17 inch to 0.19 inch, 0.19 inch to 0.21 inch, 0.21 inch to 0.23 inch, 0.23 inch to 0.25 inch, 0.25 inch to 0.27 inch, 0.27 inch to 0.29 inch, 0.29 inch to 0.31 inch, 0.31 inch to 0.33 inch, or 0.33 inch to 0.35 inch. In one exemplary embodiment, the gate diameter is 0.25 inch.

The gate 140 can be recessed from the back surface at a distance between 0.38 inch and 0.52 inch. In some embodiments, the gate recessed distance can be between 0.38 inches to 0.40 inch, 0.40 inch to 0.42 inch, 0.42 inch to 0.44 inch, 0.44 inch to 0.46 inch, 0.46 inch to 0.48 inch, 0.48 inch to 0.50 inch, or 0.50 inch to 0.52 inch. In one exemplary embodiment, the gate recessed distance is 0.42 inch.

The gate 140 further comprises a gate interface surface 142, a gate recess perimeter surface 144, and a gate opening 146. These features are used in the manufacturing process and more specifically the injection molding process described below.

The body 101 can further comprise a protrusion recess 150. The protrusion recess 150 further comprises a protrusion interface surface 152 and a protrusion recess perimeter 154. These features are used in the manufacturing process and more specifically the injection molding process described below.

Manufacturing Methods

In addition to the previously disclosed performance benefits, the golf club head of the present invention may be uniquely manufactured to offer distinct benefits regarding production time and quality. Namely, in the absence of weld between the face plate and body, a finished club head can be inserted into a mold without scratching it, removing several steps from conventional manufacturing methods and ensuring higher production quality.

The club head may be manufactured by first forming the face plate and body separately, using conventional techniques that are well established in the art. Further, the face plate and the body are heat treated separately. Continuing, the body is inserted into a mold, and the face plate is suspended away from the body. In some embodiments, the mold is a silicone lined mold. Further, the bonding material is inserted between the face plate and body. A finished club head is removed from mold, wherein the face plate and body are coupled solely via the bonding material.

Figure 10:
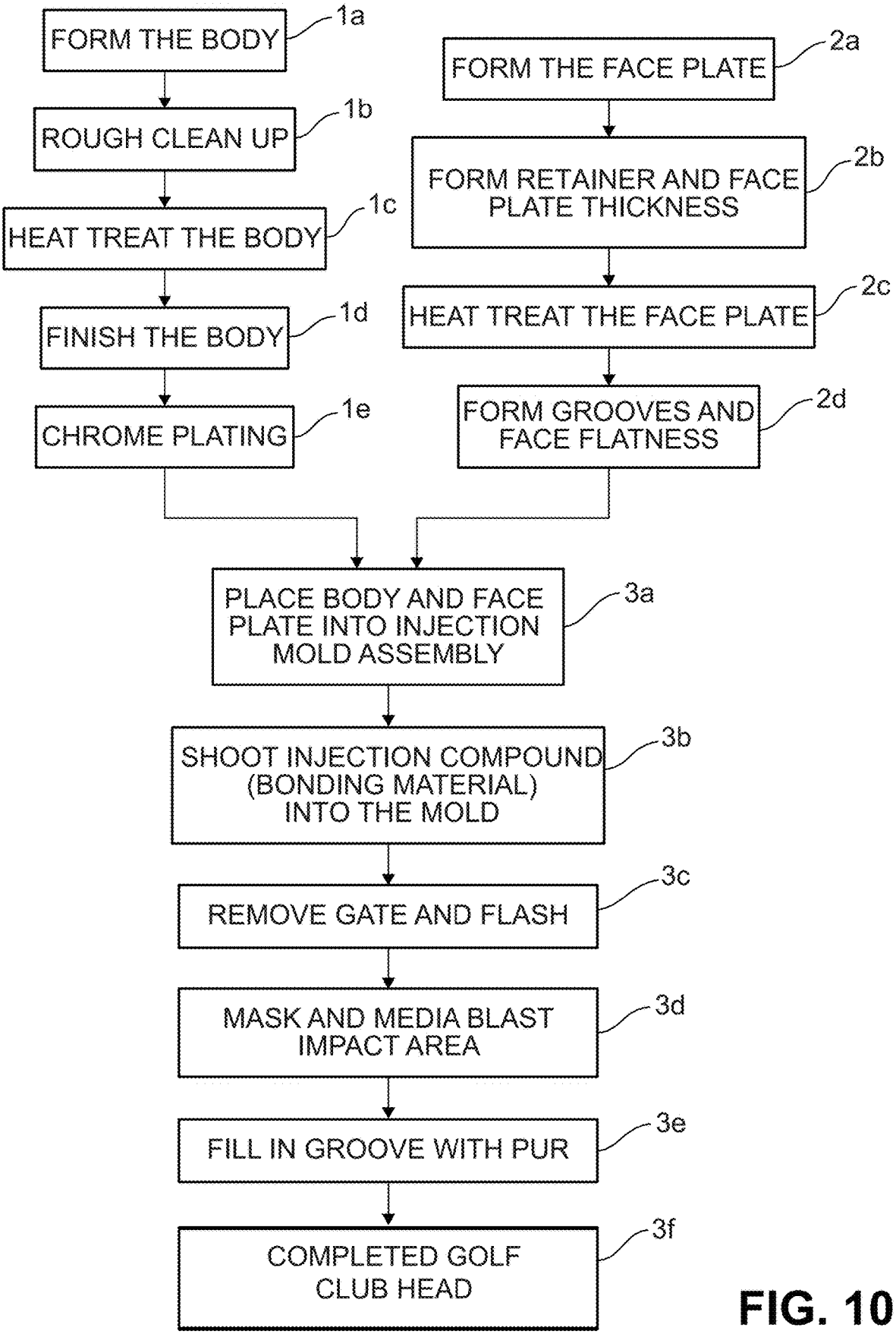
FIG. 10 illustrates a step wise manufacturing process according to the present invention.
Figure 11:
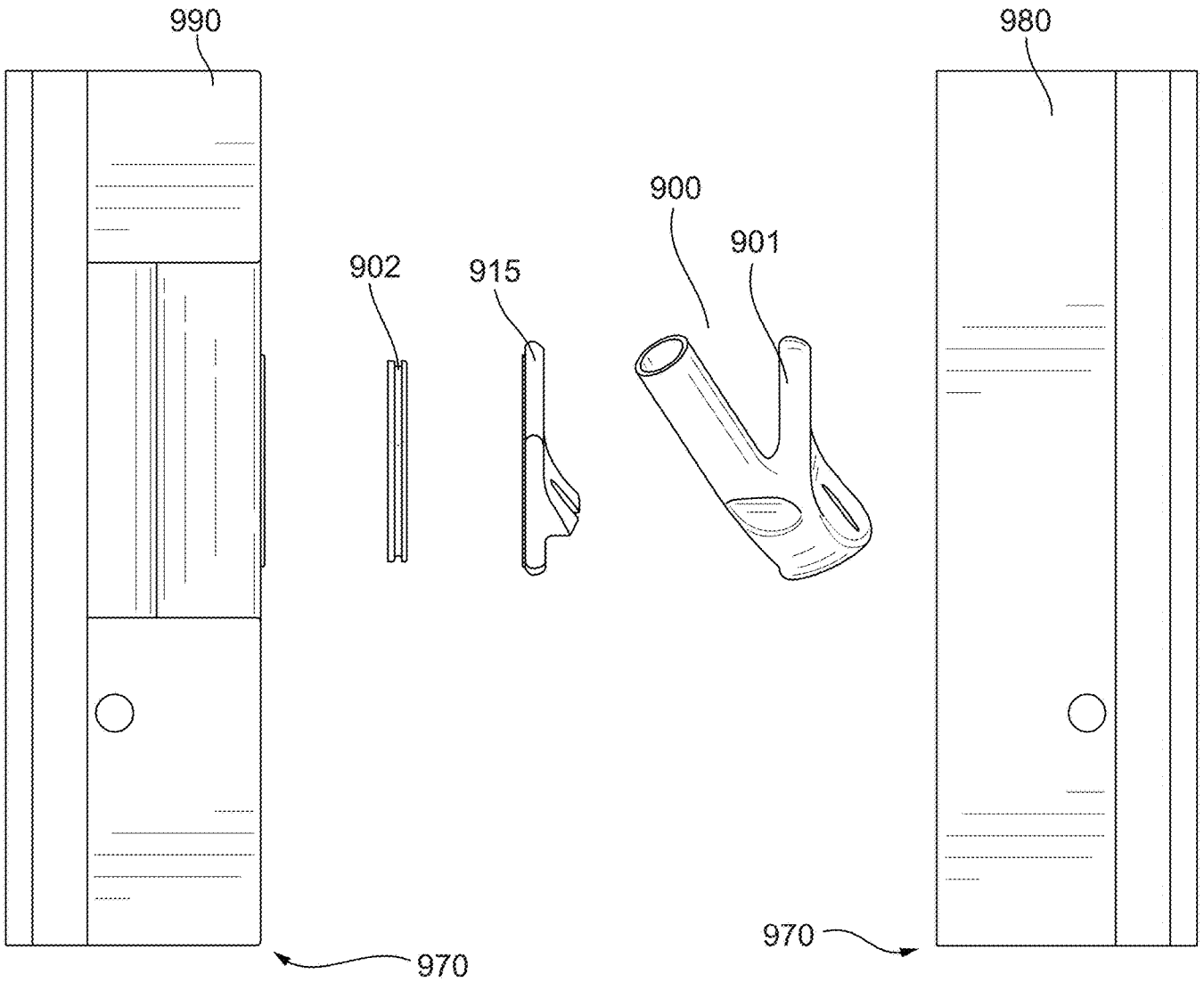
FIG. 11 illustrates an exploded view of an injection molding assembly according to the present invention.
Figure 12:
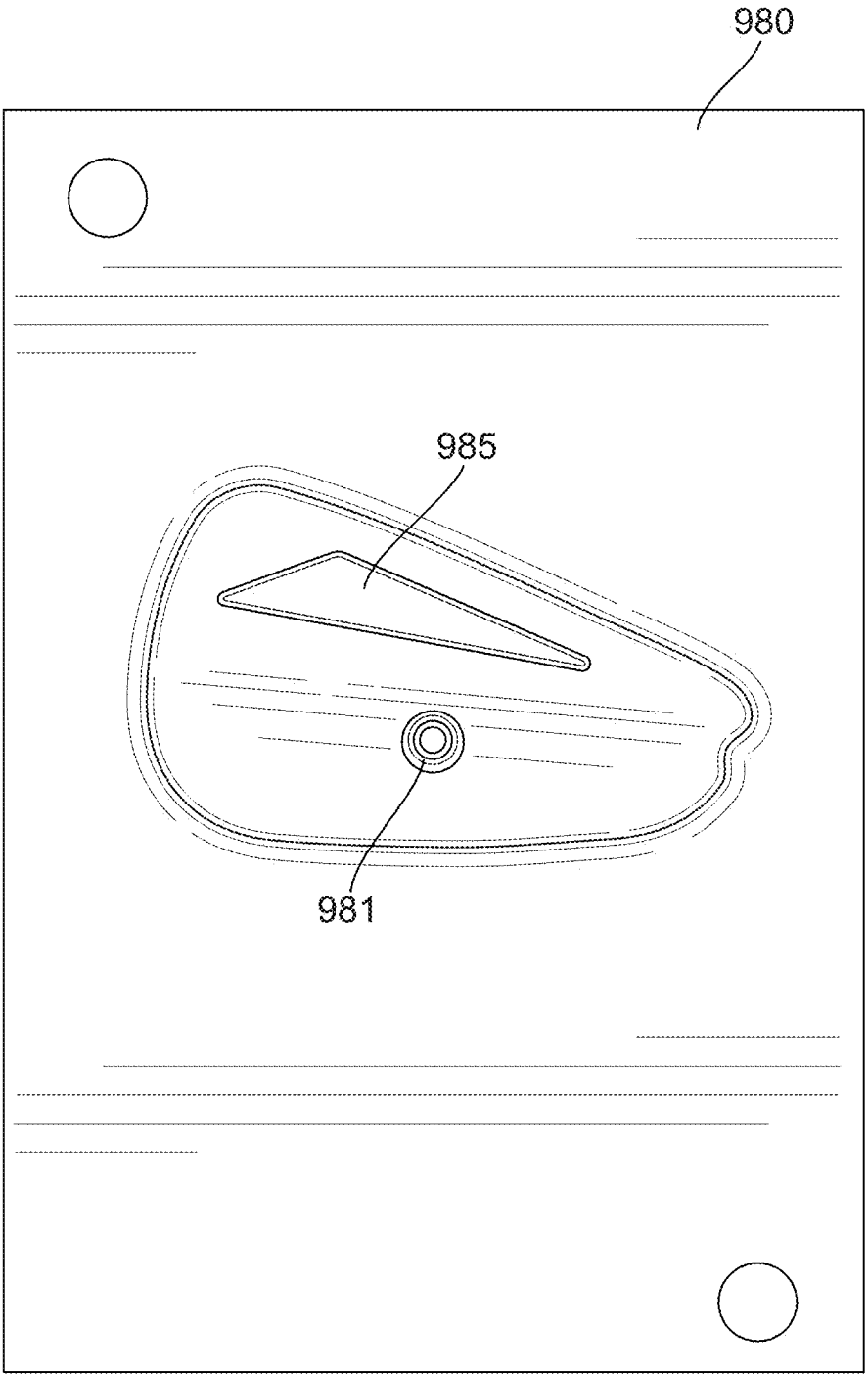
FIG. 12 illustrates a front view of an A side of the injection molding assembly according to the present invention.
Figure 13:
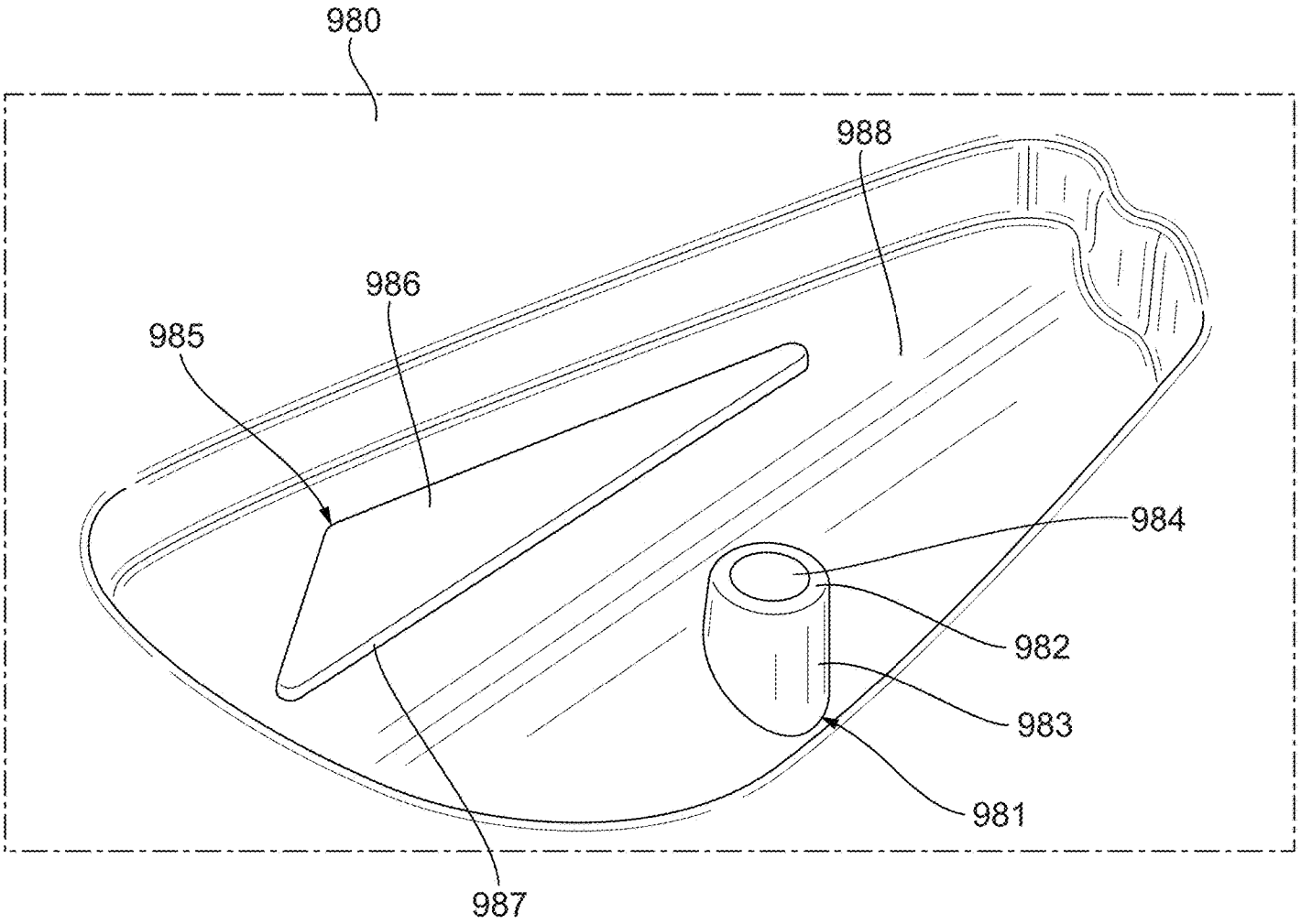
FIG. 13 illustrates a close view the A side of the injection molding assembly according to the present invention.
Figure 14:
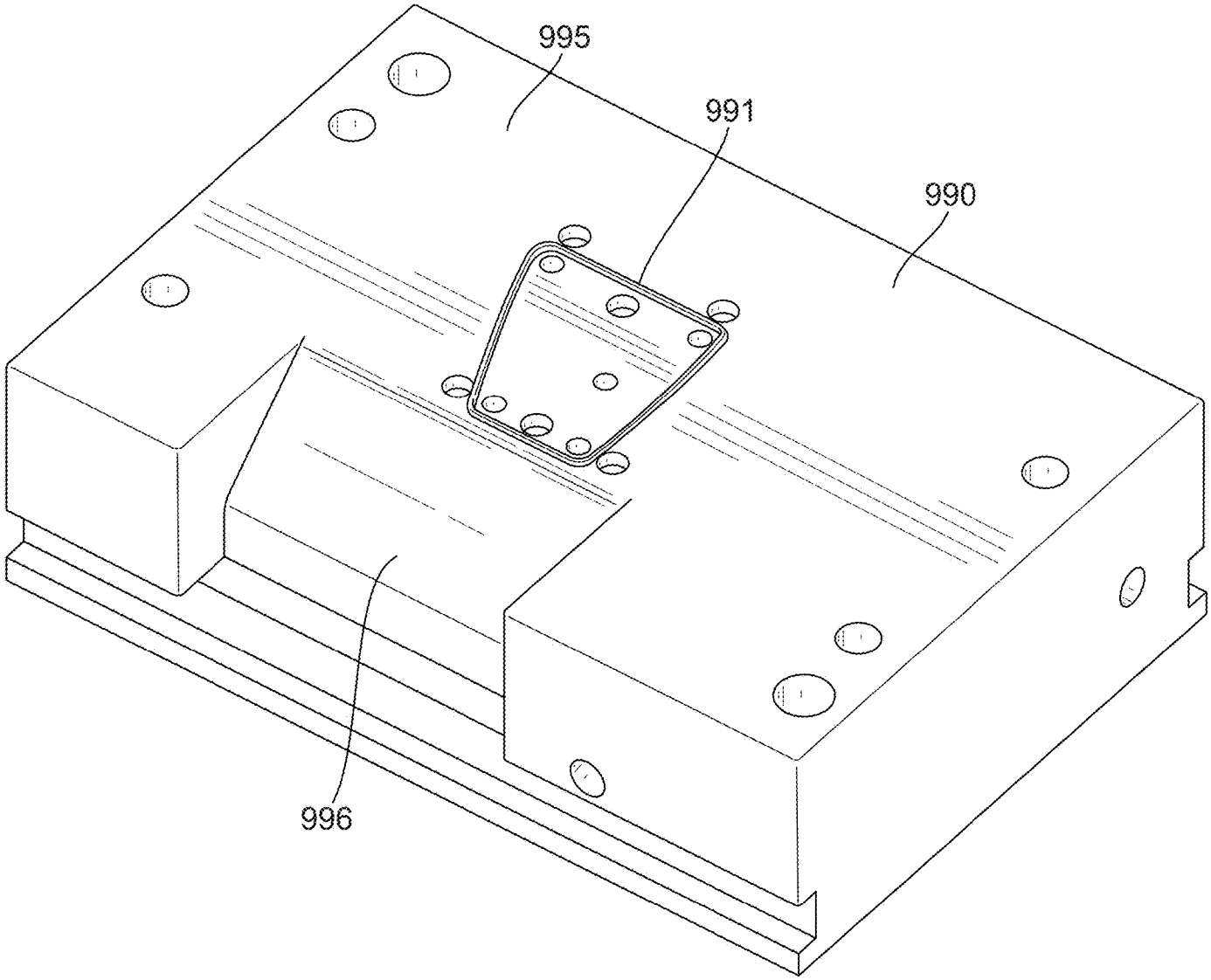
FIG. 14 illustrates a perspective view of a B side of the injection molding assembly according to the present invention.
Figure 15:
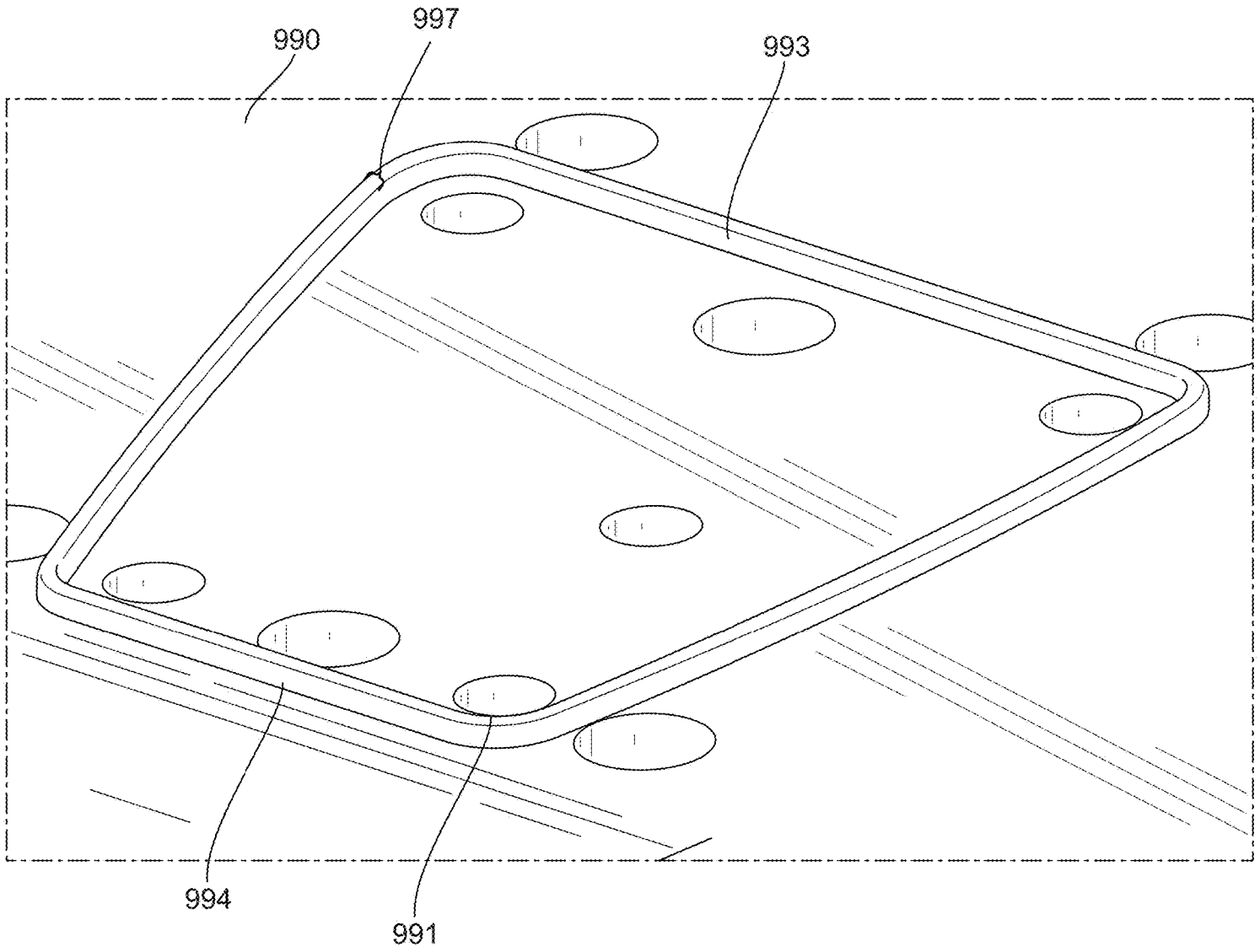
FIG. 15 illustrates a close perspective view of the B side of the injection molding assembly according to the present invention.
Figure 16:
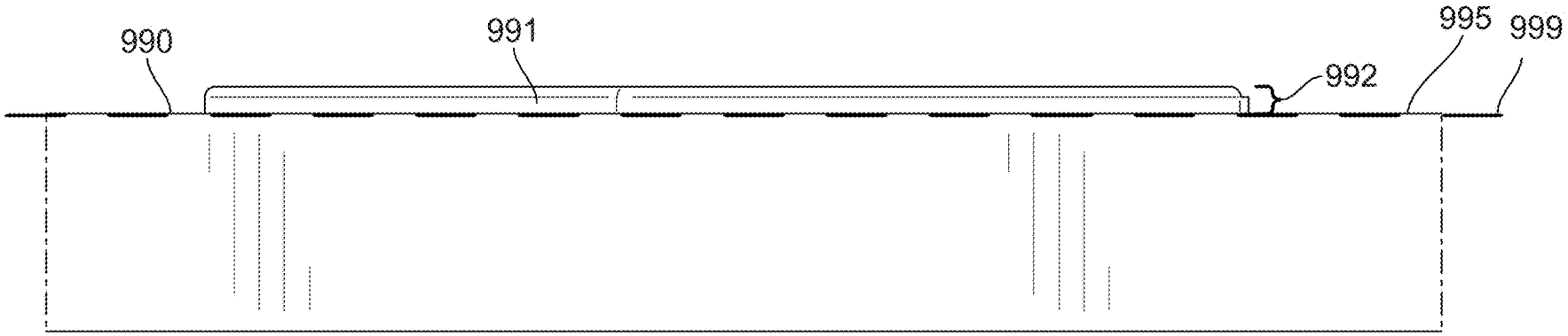
FIG. 16 illustrates a side view of the B side of the injection molding assembly according to the present invention.
Figure 17:
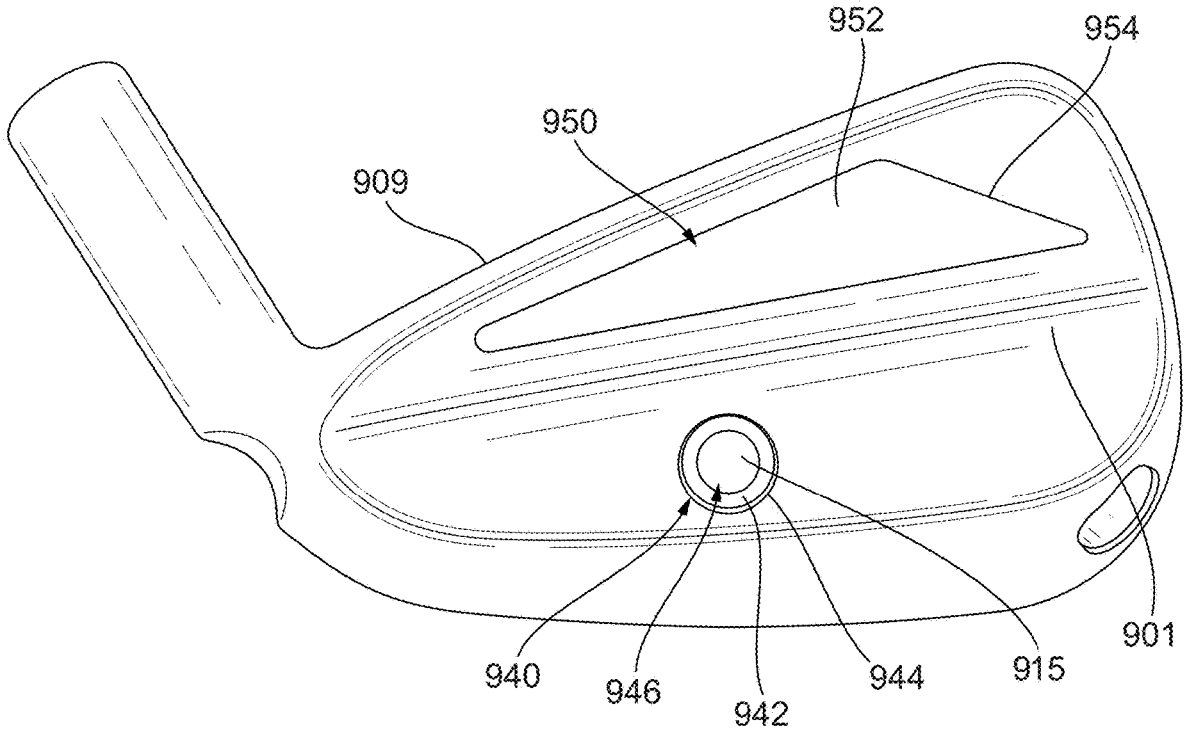
FIG. 17 illustrates a rear view of a club body used in the injection molding assembly according to the present invention.

Referring to FIG. 10, a manufacturing process is depicted in a step wise fashion. Further referring to, FIG. 11, depicts an injection molding assembly 970 exploded view. The manufacturing process can be separated into 3 distinct manufacturing steps. Each of the 3 steps comprises a subset of steps. The 3 distinct steps comprise manufacturing a body 901, manufacturing a face plate 902, and manufacturing a club head 900.

Steps 1*a*-1*e* depict a subset of steps to manufacture a body 901 similar to bodies 101 and 501 described above. In step 1*a* the body 901 is formed by known manufacturing methods such as casting, forging, or milling. In step 1*b* the body 901 is subjected to a rough clean up. The rough clean up removes any excess material and gives the body 901 a rough shape. In step 1*c* the body 901 is subjected to a heat treatment. In step 1*d* the body 901 is finished by grinding, polishing, or machining. In an optional step 1*e* the body 901 can be chrome plated. The body 901 formed by steps 1*a*-1*e* does not require any further finishing such as polishing, grinding or plating.

Steps 2*a*-2*d* comprise manufacturing a face plate 902 similar to face plates 102 and 502 described above. In step 2*a* the general shape of the face plate 902 is formed by casting, forging, or milling. In step 2*b* a retainer 920 similar to 120 and 520 is formed in the face plate 902. In step 2*c* the face plate 902 is subjected to a heat treatment. In step 2*d* grooves and face flatness can be formed on the face plate 902.

Steps 3*a*-3*f* comprise manufacturing a golf club head 900 via injection molding. With reference to FIGS. 11-17, an injection molding assembly 970 comprises an A side 980 and a B side 990. The A side 980 comprises a gate 981. The gate 981 further comprises an opening 984, a body interface surface 982, and a club complementary geometry 983. The opening 984 is concentric with a gate opening 946. The opening 984 provides a pathway for the bonding material 915 to flow during injection molding process. The body interface surface 982 forms a seal with a gate interface surface 942. The seal prevents the bonding material 915 from flowing outside of the internal cavity (not shown similar to 106). The club complementary geometry 983 can complement gate recess perimeter 944.

The A side 980 can further comprise a body recess 988 and a protrusion 985. The body recess 988 is complementary to the shape of the body 901. The protrusion 985 is complementary to a protrusion recess 950. The protrusion 985 comprises a top interface surface 986 and an outer perimeter surface 987. The top interface surface 986 has a complementary geometry to a protrusion recess perimeter 954. The top interface surface 986 transfers the force to the body 901 via a protrusion interface surface 952. The force holds the body 901 in place during the injection molding process. The outer perimeter surface 987 and the body recess 988 prevent the body 902 from rotating during the injection process.

In step 3*a* the face plate 902 and the body 901 are placed into the B side 990. The B side 990 comprises a fence 991. The fence 991 locates the face plate 902 and the body 901 such that they are in their final position before the injection molding process of step 3*b* commences. The face plate 902 is placed within the fence 991. The fence 991 comprises a face plate interface surface 993. The face plate interface surface 993 runs along the face plate 902 perimeter forming a seal between the face plate 902 and the B side 980. The seal between the face plate 902 and the B side 990 provides a barrier for the bonding material 915 as it is injected into an internal cavity (not shown similar to 106). The fence 991 comprises a club interface surface that corresponds to a fence opening in the body 901 (not shown similar to fence opening 129). The fence 991 prevents the face plate 902 and the body 901 from rotating during the injection molding process.

The fence 991 can further comprise a fence height 992 and fence width 997. The fence height 992 can be between 0.005 inch and 0.125 inch. The fence width 997 can be between 0.001 inch and 0.125 inch. The fence height 992 and the fence width 997 may be configured to minimize the lip size as described above while still containing the bonding material 915 within the internal cavity (not shown similar to 106 and 506).

The B side 990 can further comprise a top surface 995 that defines a B side plane 999. The face plate sits flush with the B side plane 999. Further, the top interface surface 986, the body interface surface 982, the gate interface surface 142, and the protrusion interface surface 152 are parallel to the B side plane 999. Having these surfaces parallel to the B side plane 999 ensures smooth transfer of forces between the injection molding assembly 970 and the body 901.

Once the body 901 is placed in the A side 980 and the face plate 902 is placed in the B side 990 the injection molding assembly 970 is closed, then step 3*b* commences. The bonding material 915 is injected into the injection molding assembly 970 through the gate 981. In step 3*c* any excess bonding material 915 that is outside the internal cavity is removed, which includes the gate 981 and the flash.

In step 3*d* the club head 900 is masked, except for an impact area. The impact area is designed to strike a golf ball. The impact area is then media blasted. The media blast provides the impact area with a texture to impart spin on the golf ball and reduce glare on the club head 900. From the injection molding process a groove is left from the fence 991, the groove can be filled in with a suitable material such as a polyurethane. Once steps 1*a*-1*e*, 2*a*-2*d*, and 3*a*-3*e* are completed, this results in a completed golf club head 900 in step 3*f*. The completed golf club head 900 does not require any further manufacturing processes such as grinding, polishing, or milling.

Further, several examples are discussed in detail below.

EXAMPLES

Example 1—Baseline Performance

In a first example, an embodiment of the present invention was compared to an existing players-style iron. The purpose of this test was to demonstrate that co-molding the face plate and body, instead of welding, did not setback performance. Specifically, the motivation for the test was that if a stainless steel co-molded iron performed like a stainless-steel welded iron, then leveraging the unique advantages of the co-molded iron, such as diverse material selection, face plate thinning, body thinning, and embedded weighting, would improve performance off a baseline aligned with conventional club head performance.

Generally, this example compares two club heads of similar face thickness and face material, but one of the club heads comprised a bonding material, while the other comprised a solid, uniform body, wherein the face plate and body were welded together. Specifically, the embodiment tested comprised a stainless-steel face, and a face plate thickness of approximately 0.07 inches. Similarly, the conventional club head tested also comprised a stainless-steel face plate with a thickness of approximately 0.07 inches. Further, the bonding material had a density of approximately 1.42 g/cm$^3$ and was made from a thermoplastic composite. Specifically, the bonding material comprised a TPU resin reinforced by 12.7 mm long carbon fiber, wherein the bonding material was 40% carbon fiber by volume, and 60% TPU by volume.

Further, the test comprised player testing, wherein the club head was used by players representing a range of handicaps between −4 and 12. The results are summarized in the table below.

TABLE 1

Baseline Performance Changes

| Performance Metric | % Change (Relative to Existing Player-Style Iron) |
|---|---|
| MOI | −2.00% |
| Ball Speed | 0.53% |
| Launch Angle | −2.00% |
| Spin Rate | −3.34% |

Generally, this first example revealed similar performance between the tested present invention embodiment and the control, player-style iron. Specifically, the testing revealed a minor difference in MOI, wherein the conventionally welded club head had an MOI of approximately 434 g*in$^2$ and the exemplary club head had an MOI of approximately 424 g*in$^2$.

Further, the test revealed a difference in average ball speed of approximately 0.5 miles per hour and a difference in launch angle of approximately 0.4 degrees. Ultimately, the tests reveal that introducing the bonding material, instead of welding, does not setback club head performance. Accordingly, leveraging the unique advantages of the present invention, such as diverse material selection, face plate thinning, body thinning, and embedded weighting, will improve performance from baseline performance metrics that align with existing player-style irons. Accordingly, this example demonstrates that incorporating unique materials and components, such as a low-density, thin, face plate, as the bonding material facilitates, will provide unique performance over conventionally welded club heads.

Example 2—Baseline Durability

Further, the first example embodiment was subject to air cannon durability testing. Namely, the club head was subject to thousands of high energy collisions with a golf ball. The purpose of the test was to demonstrate that co-molding the face plate and body, instead of welding, did not reduce durability.

The club head demonstrated substantially similar durability characteristics as the player-style iron examined in the first example. Specifically, the exemplary club head sustained at least 3500 hits. Accordingly, this example demonstrates that utilizing the bonding material, instead of traditional welding, does not decrease durability.

Example 3—Low Density Face Plate (Titanium)

In a third example, an embodiment of the present invention comprised a titanium face plate and a steel body, wherein the face plate and body were co-molded together through the bonding material and retainer. The purpose of the test was to demonstrate that a face plate and body formed of different materials could be co-molded together. The test was also intended to demonstrate that utilizing a titanium face plate would improve MOI.

While titanium face plates have been used in wood-type golf clubs, they have not been used on steel irons. Typically, engaging titanium and steel requires adhesive bonding or mechanical fastening. Such mechanisms can be heavy, expensive, and can contribute to significant manufacturing delays and inconsistencies. Here, however, a titanium face plate was integrated with a steel body via the bonding material and retainer.

Specifically, the face plate thickness was approximately 0.07 inches, like the exemplary embodiments tested in example 1 and 2. The face plate density, however, was approximately 4.0 g/cm$^3$. By contrast, steel has a density of approximately 8 g/cm$^3$. Accordingly, the face plate density was approximately 50% lower than the face plate density in the first example club head.

The result was an increase in MOI relative to the first example club head. Namely, MOI increased relative to the first example club head by approximately 4.5% despite comprising substantially the same face plate thickness and club head mass. Specifically, the exemplary club head comprising a titanium face plate had an MOI of approximately 440 g*in$^2$.

Example 4—Thin Face Plate

In a fourth example, an embodiment of the present invention is compared to the same player-style iron discussed in the first example. Here, however, the face plate for the present invention embodiment is approximately 28% thinner than in the first example. Specifically, the exemplary club head has a face plate thickness of approximately 0.04 inches.

As previously discussed, incorporating such a thin face plate is facilitated by the unique structure of the present invention, wherein the bonding material engages the face plate and body. By providing support to the face plate, and eliminating the need for welding, the face plate can be very thin, without sacrificing durability.

By integrating a substantially thinner face plate, MOI increases relative to the club heads in the first example. Specifically, MOI increases by approximately 10%.

Accordingly, this example demonstrates that the unique structure of the present invention provides a platform from which desirable structural changes can be integrated. For example, while integrating a thinner club face is known to improve performance, durability has been a restricting factor. The present invention, however, comprises desirable structural elements, such as a very thin face, without sacrificing durability.

Example 5—Low Density Face Plate (Metal Matrix Composite)

In a fifth example, an embodiment of the present invention comprises a low-density face plate to maximize moment of inertia. Namely, the face plate comprises a metal matrix, a magnesium matrix, or composite. The face plate density is approximately 1.8 g/cm$^3$ and the face plate thickness is approximately 0.07 inches. Notably, the face plate density is approximately 77% lower than the face plate density in the first example. As a result, the MOI increases relative to the first example club heads despite comprising substantially the same face plate thickness and club head mass. Specifically, the MOI increases by approximately 15%.

Example 6—High Hardness Face Plate

In a sixth example, a club head like the first example club head comprises a substantially high hardness face plate. Namely, the club head comprises a D2 tool steel face plate, with a Rockwell hardness of approximately 60 HRC. The club is a wedge-type golf club. This face plate is approximately between 1.5 and 2.5 times harder than a typical stainless steel face plate, like the one used in the first example club head. By integrating a substantially harder face plate, the club head durability is expected to increase substantially. Specifically, the rate of spin rate decrease is expected to improve between approximately 35 and 65 RPM, per 500 hits. Namely, where the exemplary club and control club produce similar baseline spin rates, the exemplary club head will produce spin rates that are between approximately 35 and 65 RPM greater than the control club after 500 hits. Given that spin rates typically drop off by approximately 100 RPM every 500 hits, the exemplary club head demonstrates a spin rate drop off that is approximately between 35% and 65% less than a typical wedge.

Example 7—Tungsten Weighting

In a seventh example, the club head comprises a first weight, and a second weight, inside the club head volume. Both the first weight and the second weight are formed from tungsten. Additionally, the weights are not welded to either the face plate or the body. Instead, the weights are embedded inside the club head via the bonding material. Further, the first weight is located near the sole and heel, and the second weight is located near the sole and toe. Both weights are approximately 20 grams. Further, the exemplary club head comprises a titanium face plate. Specifically, the face plate thickness is approximately 0.07 inches. The fate plate density is approximately 4.0 g/cm$^3$.

Accordingly, club head MOI increases relative to the first example control club head. Specifically, MOI increases between approximately 15% and 20% despite comprising substantially the same face plate thickness and club head mass. Effectively, since the low-density bonding material holds the club head together, the club head has less structural mass. Accordingly, discretional mass can be allocated, as in this exemplary club head, to improve MOI.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus, methods, and articles of manufacture described herein may be applicable to other types of golf club such as a driver wood-type golf club, a fairway wood-type golf club, a hybrid-type golf club, an iron-type golf club, a wedge-type golf club, or a putter-type golf club. Alternatively, the apparatus, methods, and articles of manufacture described herein may be applicable to other types of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

CLAUSES

Clause 1. An iron-type golf club head, comprising;
a face plate, a body, and a bonding material;
wherein the body comprises a sole, and top rail;
the bonding material is substantially disposed between the face plate and body;

the bonding material crosslinks the face plate to the body;

the face plate is not welded to the body;

the face plate comprises at least one retainer disposed within a volume of the golf club head;

the bonding material engages both the at least one body locking geometry and the at least one retainer; and the face plate further comprises a face plate density;

the body further comprises a body density;

the club head further comprises a density ratio;

wherein the density ratio is the ratio of the body density to the face plate density; and the density ratio is greater than 1.

Clause 2. The iron-type golf club head of clause 1, wherein the at least one retainer comprises at least one circular hole.

Clause 3. The iron-type golf club head of clause 1, further comprising a face plane, and an offset;

wherein the face plane is parallel to the face plate;

the face plane is coplanar with the face plate;

the offset is a distance between the face plate and body, measured along the face plane; and the offset is substantially constant across the face plate.

Clause 4. The iron-type golf club head of clause 3, wherein the offset is between 0.001 inch and 0.125 inch.

Clause 5. The iron-type golf club head of clause 1, wherein the density ratio is greater than 3.

Clause 6. The iron-type golf club head of clause 1, wherein the density ratio is greater than 4.

Clause 7. The iron-type golf club head of clause 1, wherein the face plate hardness is greater than 35 HRC.

Clause 8. The iron-type golf club head of clause 1, wherein the face plate hardness is greater than 50 HRC.

Clause 9. The iron-type golf club head of clause 1, wherein the bonding material comprises a resin selected from a group consisting of Thermoplastic composite (TPC), and Thermoplastic polyurethane (TPU).

Clause 10. An iron-type golf club head, comprising;

a face plate, a body, and a bonding material;

wherein the body comprises a sole, and top rail;

the bonding material is substantially disposed between the face plate and body;

the bonding material crosslinks the face plate to the body;

the face plate is not welded to the body;

the face plate comprises at least one face plate retainer disposed within a volume of the golf club head;

the body comprises at least one body retainer disposed within a volume of the golf club head;

the bonding material engages both the at least one body retainer and the at least one face plate retainer; and the bonding material and face plate form at least one discrete void rearward of the face plate;

the face plate further comprises a face plate density;

the body further comprises a body density;

the club head further comprises a density ratio;

wherein the density ratio is the ratio of the body density to the face plate density; and the density ratio is greater than 1.

Clause 11. The iron-type golf club head of clause 10, wherein the at least one discrete void is proximate to at least one of the top rail and sole.

Clause 12. The iron-type golf club head of clause 10, wherein the face plate comprises a face plate modulus of elasticity;

the body comprises a body modulus of elasticity; and the body modulus of elasticity is less than the face plate modulus of elasticity.

Clause 13. An iron-type golf club head comprising;

a face plate, a body, and a bonding material;

wherein the body comprises a sole, and top rail;

the bonding material is substantially disposed between the face plate and body;

the bonding material crosslinks the face plate to the body;

the face plate and body are not welded together;

the face plate comprises a retainer disposed within a volume of the golf club head;

the retainer comprises a groove around the face plate perimeter;

the bonding material engages the retainer; and the face plate further comprises a face plate density;

the body further comprises a body density;

the club head further comprises a density ratio;

wherein the density ratio is the ratio of the body density to the face plate density; and the density ratio is greater than 1.

Clause 14. The iron-type golf club head of clause 13, wherein the density ratio is greater than 3.

Clause 15. The iron-type golf club head of clause 13, wherein the density ratio is greater than 4.

Clause 16. The iron-type golf club head of clause 13, wherein the face plate hardness is greater than 35 HRA.

Claim 17. The iron-type golf club head of clause 13, wherein the face plate hardness is greater than 50 HRC.

Clause 18. The iron-type golf club head of clause 13, wherein the bonding material comprises a resin selected from a group consisting of Thermoplastic composite (TPC), and Thermoplastic polyurethane (TPU).

Clause 19. The iron-type golf club head of clause 18, wherein the resin is reinforced by carbon fiber.

Clause 20. The iron-type golf club head of clause 13, wherein the face plate is formed from titanium and the body is formed from steel.

Clause 21. An iron-type golf club head defining an internal club head volume, the golf club head comprising:

a body comprising a sole, a top rail, and body opening, the body having a body density;

a face plate comprising:

a strike face disposed within the body opening and sized to form a gap between the strike surface and the body opening; and at least one retainer disposed in the internal head volume;

wherein the face plate having a face plate density; and a bonding material disposed between the face plate and the body, wherein the bonding material includes:

at least one lobe that mechanically engages with the at least one retainer to couple the face plate to the body; and a forward lip occupying the gap;

wherein a club head density ratio of the body density to the face plate density is greater than 1.

Clause 22. The iron-type golf club head of clause 21, wherein the bonding material is externally visible.

Clause 23. The iron-type golf club head of clause 21, wherein the at least one retainer forms a groove.

Clause 24. The iron-type golf club head of clause 23, wherein the groove comprises a plurality of circular cutouts.

Clause 25. The iron-type golf club head of clause 21, wherein the gap thickness, measured between the strike face and body opening, is between 0.001 inch and 0.125 inch.

Clause 26. The iron-type golf club head of clause 21, wherein the density ratio is greater than 3.

Clause 27. The iron-type golf club head of clause 21, wherein the density ratio is greater than 4.

Clause 28. The iron-type golf club head of clause 21, wherein the face plate comprises a hardness that is greater than 35 HRC.

Clause 29. The iron-type golf club head of clause 21, wherein the face plate comprises a hardness that is greater than 50 HRC.

Clause 30. The iron-type golf club head of clause 21, wherein the bonding material comprises a resin selected from a group consisting of Thermoplastic composite (TPC), and Thermoplastic polyurethane (TPU)

Clause 31. An iron-type golf club head defining an internal club head volume, the golf club head comprising:

a body comprising a sole, a top rail, and body opening, the body having a body density and body hardness;

a face plate comprising:

a strike face disposed within the body opening and sized to form a gap between the strike surface and the body opening; and at least one retainer disposed in the internal head volume;

wherein the face plate comprises a face plate density and a face plate hardness; and a bonding material disposed between the face plate and the body, wherein the bonding material includes:

at least one lobe that mechanically engages with the at least one retainer to couple the face plate to the body; and a forward lip occupying the gap;

wherein a club head density ratio of the body density to the face plate density is greater than 1; and a club head hardness ratio of the face plate hardness to the body hardness is greater than 1.

Clause 32. The iron-type golf club head of clause 31, wherein the club head comprises a loft that is at least 47 degrees.

Clause 33. The iron-type golf club head of clause 31, wherein the face plate hardness is at least 45 HRC.

Clause 34. The iron-type golf club head of clause 31, wherein the face plate hardness is at least 50 HRC.

Clause 35. The iron-type golf club head of clause 31, wherein the face plate hardness is at least 55 HRC.

Clause 36. The iron-type golf club head of clause 31, wherein the face plate hardness is at least 60 HRC.

Clause 37. The iron-type golf club head of clause 31, the bonding material having a compressive strength of at least 80 Ksi.

Clause 38. The iron-type golf club head of clause 31, the bonding material comprising a resin and fibers;

wherein the resin comprises a material selected from thermoplastic polyurethane (TPU) and thermoplastic composite (TPC); and Clause 39. The iron-type golf club head of clause 38, the fibers having a length between 0.01 mm and 12 mm.

Clause 40. The iron-type golf club head of clause 38, wherein the bonding material comprises both continuous and discontinuous fibers.

Clause 41. An iron-type golf club head defining an internal club head volume, the golf club head comprising:

a body comprising a sole, a top rail, and body opening, an outer surface, and in inner surface, the body having a body density and body hardness;

the body inner surface forms a frame;

a face plate comprising:

at least one retainer disposed in the internal head volume;

wherein the face plate comprises a face plate density and a face plate hardness; and the face plate and frame form a gap; and the face plate forms a portion of at least on of the sole or top rail;

a bonding material disposed between the face plate and the body, wherein the bonding material includes:

at least one lobe that mechanically engages with the at least one retainer to couple the face plate to the body; and a forward lip occupying the gap;

wherein a club head density ratio of the body density to the face plate density is greater than 1.

Clause 42. The iron-type golf club head of clause 41, wherein the face plate and bonding material form at least one discrete void behind the face plate.

Clause 43. The iron-type golf club head of clause 42, wherein the at least one discrete void is proximate the top rail.

Clause 44. The iron-type golf club head of clause 42, wherein the at least one discrete void is proximate the sole.

Clause 45. The iron-type golf club head of clause 41, wherein the face plate and bonding material form a plurality of voids behind the face plate.

Clause 46. The iron-type golf club head of clause 45, wherein the at least one of the plurality of voids is proximate the toe, and another one of the plurality of voids is proximate the heel.

Clause 47. The iron-type golf club head of clause 41, wherein the bonding material comprises a thermoplastic resin reinforced by a plurality of carbon fibers.

Clause 48. The iron-type golf club head of clause 42, the plurality of carbon fibers having a length between 0.01 mm and 12 mm.

Clause 49. The iron-type golf club head of clause 41, wherein the face is formed from a metal matrix composite and the body is steel.

Clause 50. An iron-type golf club head, comprising;

a face plate, a body, and a bonding material;

wherein the body comprises a heel end, a toe end, a sole, and a top rail;

the bonding material is substantially disposed between the face plate and body;

the bonding material crosslinks the face plate to the body;

the face plate is not welded to the body;

the face plate comprises at least one face plate retainer disposed within a volume of the golf club head;

the body comprises two or more body retainers disposed within a volume of the golf club head;

the bonding material engages both the two or more body retainers and the at least one face plate retainer; and the bonding material and face plate form two discrete voids rearward of the face plate;

the face plate further comprises a face plate density;

the body further comprises a body density;

the club head further comprises a density ratio;

wherein the density ratio is the ratio of the body density to the face plate density; and the density ratio is greater than 1.

Clause 51. The iron-type golf club head of clause 50, wherein a first discrete void is located proximate the top rail and a second discrete void is located proximate the heel end.

Clause 52. The iron-type golf club head of clause 50, wherein a first discrete void is located proximate the top rail and a second discrete void is located proximate the toe end.

Clause 53. The iron-type golf club head of clause 50, wherein a first discrete void is located proximate the sole and a second discrete void is located proximate the heel end.

Clause 54. The iron-type golf club head of clause 50, wherein a first discrete void is located proximate the sole and a second discrete void is located proximate the toe end.

Clause 55. The iron-type golf club head of clause 50, wherein a first discrete void is located proximate the heel end and a second discrete void is located proximate the toe end.

Clause 56. The iron-type golf club head of clause 51, wherein the face plate thickness is 0.04 inch.

Clause 57. The iron-type golf club head of clause 50, wherein a first body retainer is located proximate the top rail and a second body retainer is located proximate the sole.

Clause 58. The iron-type golf club head of clause 50, wherein a first body retainer is located proximate the heel end and a second body retainer is located proximate the toe end.

Clause 59. The iron-type golf club head of clause 50, wherein the at least one face plate retainer is proximate to at least one of the top rail and sole.

Clause 60. The iron-type golf club head of clause 50, wherein the bonding material comprises at least one internal weight.

The invention claimed is:

1. An iron-type golf club head, comprising;

a face plate, a body, and a bonding material;

wherein the body comprises a sole, and top rail;

the bonding material is substantially disposed between the face plate and body;

the bonding material crosslinks the face plate to the body;

the face plate is not welded to the body;

the face plate comprises at least one retainer disposed within a volume of the iron-type golf club head;

the bonding material engages both the at least one body locking geometry and the at least one retainer; and the face plate further comprises a face plate density;

the body further comprises a body density;

the iron-type golf club head further comprises a density ratio;

wherein the density ratio is a ratio of the body density to the face plate density; and the density ratio is greater than 3.

2. The iron-type golf club head of claim 1, wherein the at least one retainer comprises at least one circular hole.

3. The iron-type golf club head of claim 1, further comprising a face plane, and an offset;

wherein the face plane is parallel to the face plate;

the face plane is coplanar with the face plate;

the offset is a distance between the face plate and body, measured along the face plane; and the offset is substantially constant across the face plate.

4. The iron-type golf club head of claim 3, wherein the offset is between 0.001 inch and 0.125 inch.

5. The iron-type golf club head of claim 1, wherein the density ratio is greater than 4.

6. The iron-type golf club head of claim 1, wherein a face plate hardness is greater than 35 HRC.

7. The iron-type golf club head of claim 1, wherein a face plate hardness is greater than 50 HRC.

8. The iron-type golf club head of claim 1, wherein the bonding material comprises a resin selected from a group consisting of Thermoplastic composite (TPC), and Thermoplastic polyurethane (TPU).

9. An iron-type golf club head, comprising:

a face plate, a body, and a bonding material;

wherein the body comprises a sole and top rail;

the bonding material is substantially disposed between the face plate and body;

the bonding material crosslinks the face plate to the body;

the face plate is not welded to the body;

the face plate comprises at least one face plate retainer disposed within a volume of the iron-type golf club head;

the body comprises at least one body retainer disposed within a volume of the iron-type golf club head;

the bonding material engages both the at least one body retainer and the at least one face plate retainer; and the bonding material and face plate form at least one discrete void rearward of the face plate;

the face plate further comprises a face plate density;

the body further comprises a body density;

the iron-type golf club head further comprises a density ratio;

wherein the density ratio is a ratio of the body density to the face plate density; and the density ratio is greater than 1;

wherein the face plate comprises a face plate modulus of elasticity;

the body comprises a body modulus of elasticity; and the body modulus of elasticity is less than the face plate modulus of elasticity.

10. The iron-type golf club head of claim 9, wherein the at least one discrete void is proximate to at least one of the top rail and sole.

11. An iron-type golf club head comprising;

a face plate, a body, and a bonding material;

wherein the body comprises a sole, and top rail;

the bonding material is substantially disposed between the face plate and body;

the bonding material crosslinks the face plate to the body;

the face plate and body are not welded together;

the face plate comprises a retainer disposed within a volume of the iron-type golf club head;

the retainer comprises a groove around a face plate perimeter;

the bonding material engages the retainer; and the face plate further comprises a face plate density;

the body further comprises a body density;

the iron-type golf club head further comprises a density ratio;

wherein the density ratio is the ratio of the body density to the face plate density; and the density ratio is greater than 3.

12. The iron-type golf club head of claim 11, wherein the density ratio is greater than 4.

13. The iron-type golf club head of claim 11, wherein a face plate hardness is greater than 35 HRA.

14. The iron-type golf club head of claim 11, wherein a face plate hardness is greater than 50 HRC.

15. The iron-type golf club head of claim 11, wherein the bonding material comprises a resin selected from a group consisting of Thermoplastic composite (TPC), and Thermoplastic polyurethane (TPU).

16. The iron-type golf club head of claim 15, wherein the resin is reinforced by carbon fiber.

* * * * *